US008444283B1

(12) United States Patent
Miller et al.

(10) Patent No.: US 8,444,283 B1
(45) Date of Patent: May 21, 2013

(54) SYSTEMS AND METHODS FOR UNDERWATER LIGHTING

(71) Applicants: Steven Miller, Pinellas Park, FL (US); Robert Joseph Marques, Tarpon Springs, FL (US)

(72) Inventors: Steven Miller, Pinellas Park, FL (US); Robert Joseph Marques, Tarpon Springs, FL (US)

( * ) Notice: Subject to any disclaimer, the term of this patent is extended or adjusted under 35 U.S.C. 154(b) by 0 days.

(21) Appl. No.: 13/655,107

(22) Filed: Oct. 18, 2012

(51) Int. Cl.
*F21V 33/00* (2006.01)

(52) U.S. Cl.
USPC ..... 362/101; 362/297; 362/294; 362/373

(58) Field of Classification Search
USPC ..... 362/101, 267, 294, 373
See application file for complete search history.

(56) References Cited

U.S. PATENT DOCUMENTS 3,474,423 A * 10/1969 Krylow et al. ..... 365/97
3,510,978 A * 5/1970 Murdock ..... 43/17.1
3,569,692 A * 3/1971 Johnson et al. ..... 362/267
4,021,660 A * 5/1977 Szpur ..... 362/218
4,135,228 A * 1/1979 Lones ..... 362/18
4,158,880 A * 6/1979 McJunkin, Jr. ..... 362/276
4,574,337 A * 3/1986 Poppenheimer ..... 362/267
5,016,151 A * 5/1991 Mula ..... 362/267
5,045,978 A * 9/1991 Gargle ..... 362/101
6,616,291 B1 * 9/2003 Love ..... 362/101
7,249,867 B2 * 7/2007 Hagen et al. ..... 362/267
2005/0111222 A1 * 5/2005 Olsson et al. ..... 362/267

* cited by examiner

*Primary Examiner* — John A Ward
(74) *Attorney, Agent, or Firm* — Tiffany C. Miller

(57) ABSTRACT

An underwater dock light having an internal water cooling system formed from primary, secondary, tertiary, and quaternary mounting surfaces forming a chamber. Each of the mounting surfaces are each in thermal communication with a light emitting unit generating heat. LED circuit boards are mounted at an angle to produce a large diameter of light in the surrounding water. A light bifurcating structure causes a central portion of light to be a different color than the perimeter. The transparent lens has an opening and a latching structure configured to connect the transparent lens to the end of the transparent cover. A tire valve stem is located on the underwater light and is capable of removing or filling the underwater light with a gas. Antifouling circuitry automatically cycles the underwater light on and off multiple times during periods of non-use. Smart circuitry communicates and accepts commands by a user.

25 Claims, 26 Drawing Sheets

SYSTEMS AND METHODS FOR UNDERWATER LIGHTING

BACKGROUND OF THE INVENTION

1. Field of the Invention

This invention relates, generally, to underwater dock lights.

2. Background Art

The light emitting unit in many conventional underwater lights are incandescent bulbs that are not energy efficient. Metal hydride lighting systems require the use of bulky transformers that are also not energy efficient compared to compact fluorescent lighting (CFL) or high intensity light emitting diode (LED) systems. Transformers make the assembly more costly and are unsightly. Incandescent, metal hydride, and CFL bulbs use hazardous high voltage A/C current. When these bulbs are used in underwater lights, the use of a ground fault circuit interrupt (GFCI) is recommended for safe operation. GFCI's add additional cost to an underwater light system. LED systems can operate with non-hazardous, low voltage D/C current which is a much safer alternative to the prior art A/C systems. Moreover, incandescent bulbs, CFL bulbs, and metal hydride bulbs have a short life expectancy in comparison to LEDs.

High intensity LEDs used in light systems produce concentrated heat at each LED. Although an underwater light assembly has a relatively stable external temperature due to submersion, without a way of dissipating the heat from a concentrated point of each LED, the high intensity LED will overheat and become damaged.

There are several challenges to overcome with using high intensity LEDs in an underwater light system. One challenge being the need for the LED to be in contact with a heat sink capable of sufficiently transferring heat. The problem with a heat sink in an underwater light is determining how to cool the heat sink. Thus, there is a need for an improved method of cooling LEDs inside an underwater light.

Currently, most prior art underwater lights on the market operate in about ten feet or less of water. These underwater lights have a light emission that is configured to beam away from the light fixture housing, resulting in the light source emitting a beam of light. In shallow water, the light beaming upward results in an underwater light having a small diameter of light being illuminated. Thus, there is a need for an improved, underwater light that directs the light not only upward, but radiating outward to produce a large diameter of light being illuminated in shallow water.

Prior art underwater lights are not energy efficient compared to the diameter of light they produce. Thus, there is a need for an underwater light that produces a brighter light and a larger diameter of light in a body of water. This is more desirable to an observer and attracts more marine life to the site. More particularly, a brighter light is more effective at penetrating murky water.

Prior art underwater lights illuminate the surrounding water a single color. Thus, there is a need for an improved underwater light that illuminates the surrounding water with multiple colors simultaneously.

Prior art underwater lights incorporate a compression nut to attempt to seal an electrical cord to a light housing. However, the constant underwater tugging motion and temperature variations result in expansion, contraction, and fatigue of the electrical cord against the compression nut. This constant tugging from the water movement and temperature variations results in a high failure rate of sealing an electrical cord to a light housing, allowing water to enter the light and damage the electrical components.

Some prior art underwater lights are designed to accept an electrical cord through an opening penetrating the light housing. Liquid resin is applied to the light housing's opening to create a seal. The problem with the prior art light housing is that as the resin hardens to a solid state, it begins to shrink and pull away from the inner perimeter wall of the light housing opening.

More particularly, due to the liquid resin shrinking and pulling away from the inner perimeter wall of the light housing opening, the underwater light will leak water in a gap formed between the inner perimeter wall opening of the light housing and the hardened resin. When water leaks into an underwater light, the integrity of the unit is compromised and the unit fails. Thus, there is a need for an improved sealing structure that produces a permanent, water-tight seal.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for an underwater light that is adapted to be internally water cooled by a thermally conductive housing having LED circuit boards mounted at an angle to produce a large diameter of light and a housing having an integrated surrounding water sealing structure which also includes improvements that overcome the limitations of prior art underwater lights, is now met by a new, useful, and non-obvious invention.

The novel underwater light includes a transparent cover positioned over a light fixture housing. The transparent cover is adapted to fit over a light emitting unit including, but not limited to, an LED. Any light emitting unit is within the scope of this invention. The light fixture housing has an integrally formed sealing structure located opposite a light emitting unit. The sealing structure is defined by a primary sealing surface at the base of the sealing structure located opposite a secondary sealing surface at the peak of the sealing structure. The cavity at the base of the light fixture housing is located adjacent to the primary sealing surface at the base of the sealing structure. The cavity at the peak of the light fixture housing is located adjacent to the secondary sealing surface at the peak of the sealing structure. A primary sealing structure opening in the sealing structure accommodates an electrically conductive element including, but not limited to, a wire, a port tube, or a light socket adapted to penetrate the sealing structure opening from a point external of the light fixture housing. The primary sealing structure opening has a liquid resin in contact with the sealing structure and the electrically conductive element. This electrically conductive element is connected in electrical communication with a light emitting unit. The secondary sealing structure opening accepts an electrically conductive element including, but not limited to, an electrical cord.

A liquid resin substantially fills the cavity at the base of the light fixture housing and comes into contact with the sealing surface at the base of the sealing structure. The liquid resin substantially fills the cavity at the peak of the light fixture housing and comes into contact with the sealing surface at the peak of the sealing structure. When the liquid resin hardens to a solid state its unitary structure conforms to the primary sealing surface at the base of the sealing structure and the secondary sealing surface at the peak of the sealing structure. This results in the electrically conductive element and the sealing structure to be permanently sealed from an external water source.

This improved integrally formed sealing structure with a primary sealing surface opposing a secondary sealing surface for the liquid resin to conform to as it hardens results in a sealing structure producing a permanent, water-tight seal. An electrical power cord is permanently sealed regardless of a gap forming between the inner perimeter wall opening of the light housing and the hardened resin. By constructing this sealing structure, the use of a liquid resin and the shrinking nature of resin during hardening, makes such a sealing structure produce a permanent, water-tight seal. This is due to the constriction of the hardened resin around the surfaces of the sealing structure.

This novel invention also includes an improved transparent cover being one color and having a transparent lens being a different color. More particularly, the preferred combination is a colored lens to emit a dark colored light located in the center portion of the light projected through the water and a clear cover to emit a white light or lighter color to the outer perimeter of light projected through the water. This combination attracts marine life to the center dark color beam of light while the outer lighter color perimeter light allows spectators to view marine life more vividly. Though multi-color underwater lights aid in attracting and viewing marine life, they are also aesthetically pleasing to spectators. The transparent cover may have a lens that is permanently attached to the transparent cover. Additionally, the transparent cover may have a lens that is removable from the transparent cover. This removable feature is accomplished with the transparent lens having a transparent lens latching structure that is inserted into a transparent cover opening.

The improved water cooling system dissipates the concentrated heat associated with LEDs to a point external of an underwater light, resulting in a substantially brighter light without damaging the LEDs. By having a stable way of cooling LEDs with water, the LEDs can be safely overdriven, producing a brighter light than they were originally designed to produce.

BRIEF DESCRIPTION OF THE DRAWINGS

For a fuller understanding of the nature and objects of the invention, reference should be made to the following detailed description, taken in connection with the accompanying drawings, in which:

FIG. 19 is a side perspective view depicting an embodiment of the thermally conductive housing having an opening at its peak for water to flow through;

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
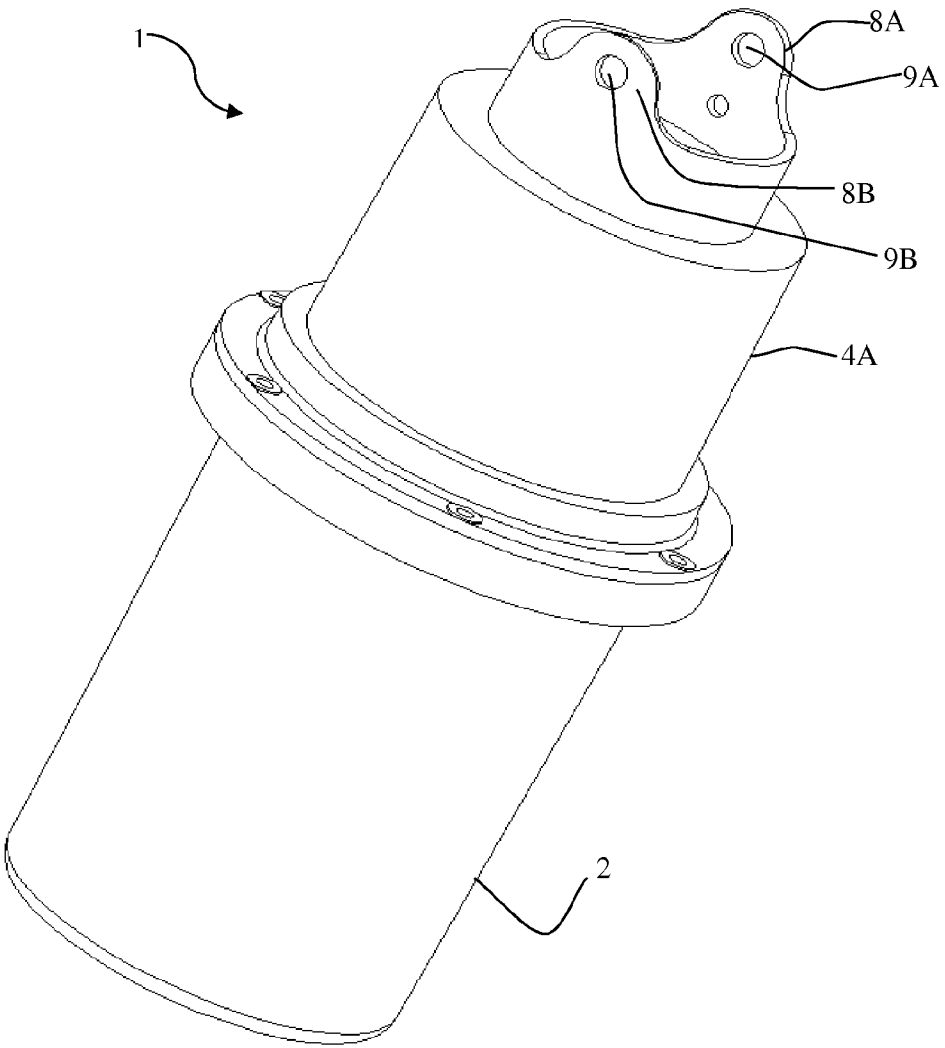
FIG. 1 is a perspective view of the novel underwater light.

In a preferred embodiment, FIG. 1 shows the underwater light 1 has light fixture housing 4A located opposite transparent cover 2. Light fixture housing 4A has attaching structures 8A and 8B located on an end of the light fixture housing 4A. Attaching structures 8A and 8B are configured to equally suspend underwater light 1 in a body of water. Underwater light 1 is buoyant because its mass is less than the mass of water it displaces. Attaching structures 8A and 8B each have attaching structure opening 9A and 9B to receive an attaching element (not shown). The attaching element (not shown) includes, but is not limited to; a rope, tether, tie strap, or a chain. Attaching structures 8A and 8B receive an attaching element (not shown) connected to an anchor configured to suspend underwater light 1 in a vertical orientation when submerged in a body of water.

Figure 3:
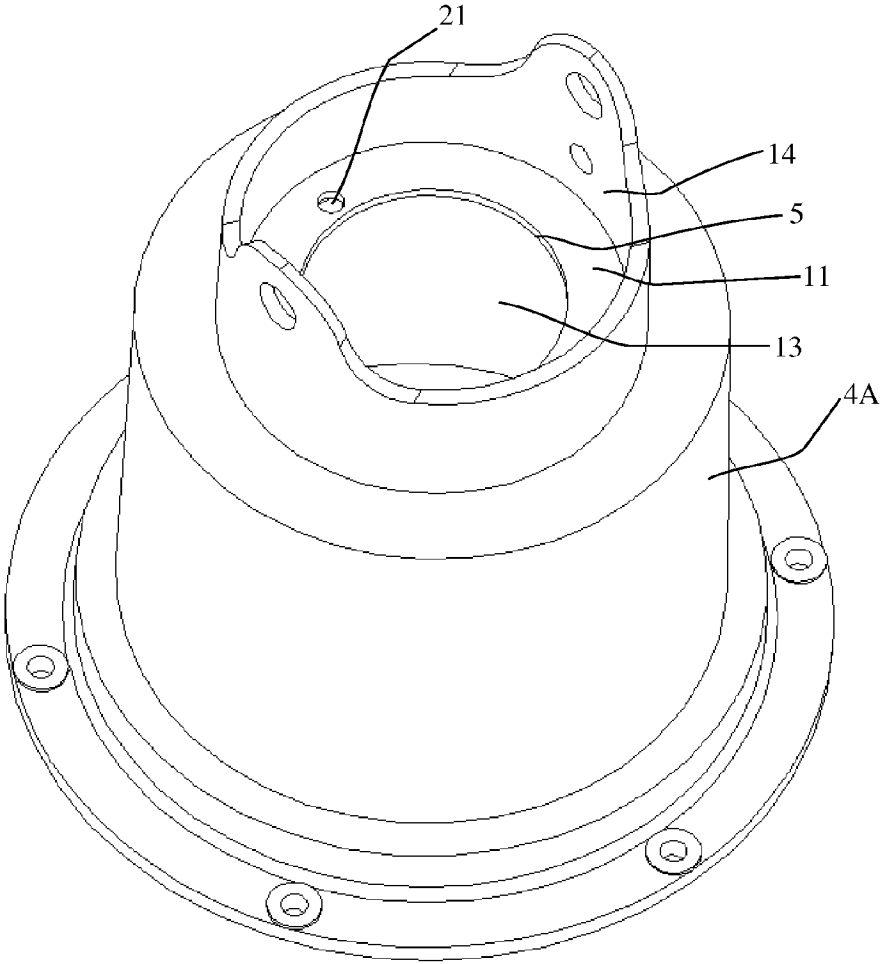
FIG. 3 is a rear perspective view of the light fixture housing.
Figure 4:
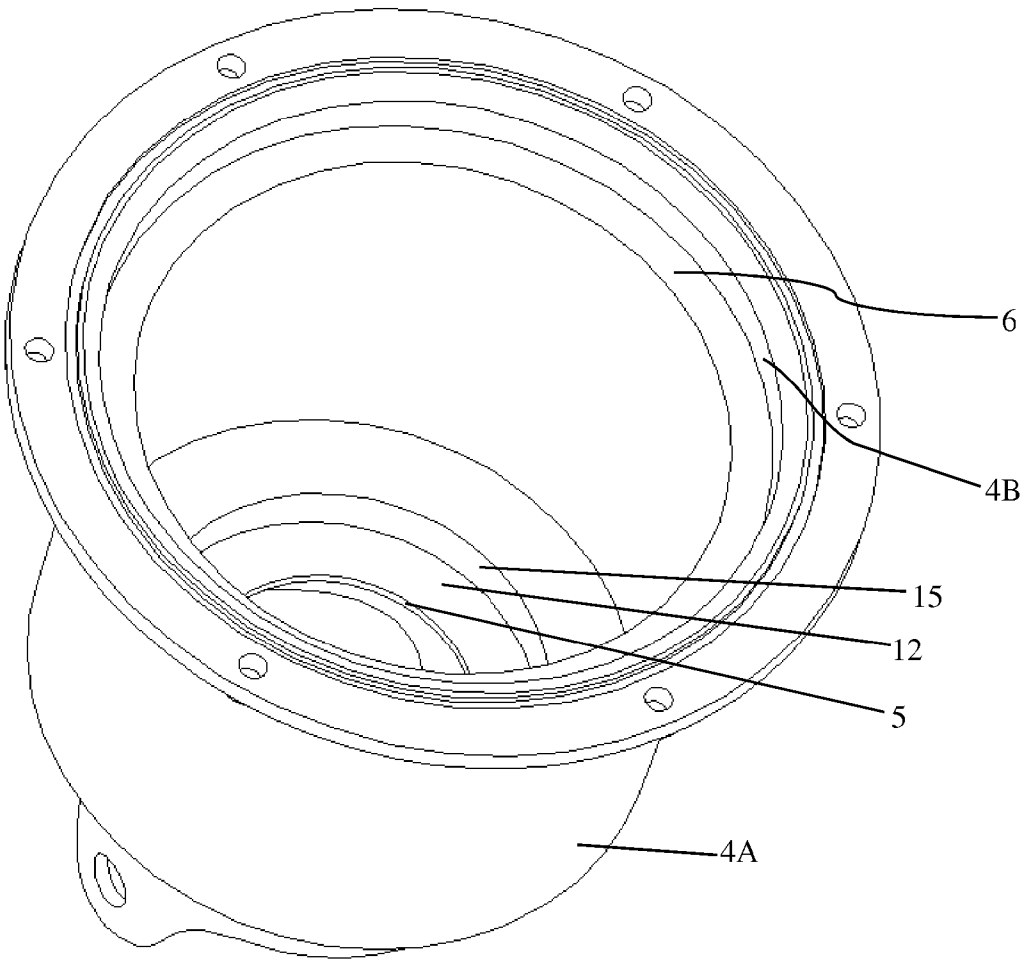
FIG. 4 is an inside perspective view of the light fixture housing.

FIG. 3 shows light fixture housing 4A having secondary sealing structure opening 21 located on sealing structure 5 to receive an electrically conductive element (not shown). A liquid resin (not shown) is in direct contact with sealing structure opening 21 and primary sealing structure opening 13, permanently sealing the electrically conductive element from surrounding water. FIG. 4 shows, light fixture housing 4A on which sealing structure 5 and support surface 6 are formed. Support surface 6 receives a pliable support material (not shown) that surrounds the light bulb (not shown).

Figure 25:
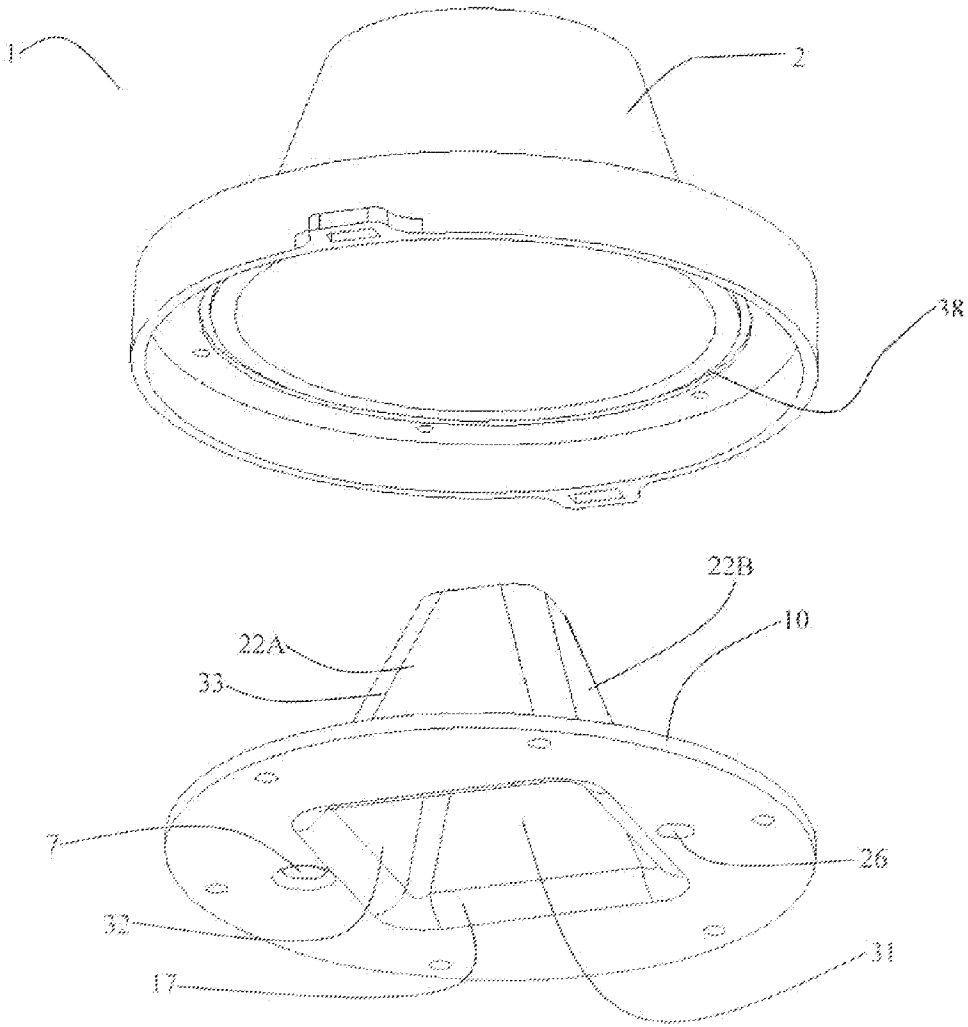
FIG. 25 is a rear exploded view depicting an embodiment of the transparent cover and thermally conductive housing; and, FIG. 26 is a side cut away exploded view depicting the transparent cover and thermally conductive housing.

FIG. 25 illustrates one embodiment of housing 10 having valve stem opening 26 capable of removing or filling underwater light 1 with a gas including, but not limited to; an inert gas. It is also within the scope of this invention to evacuate underwater light 1 of all gas and to be left in a state of vacuum. The removal of air containing moisture eliminates the oxidation of internal electrical components. Additionally, pressurizing underwater light 1 allows the assembly to be post tested for potential leaks at the point of manufacture. Pressure inside the assembly also adds a counter force to the crushing effects of water at a depth. It is also within the scope of this invention to connect an opening of the light to a regulated and pressurized gas supply that would fill or release a gas inside of underwater light 1 to maintain a constant force against the crushing effects of surrounding water, even at extreme depths. Uses for the invention could branch out to marine exploration or construction.

Underwater light 1 has antifouling circuitry (not shown) configured to automatically cycle a power interrupt circuit (not shown) to underwater light 1 "on" and "off" multiple times during periods of non-use. The frequency and duration of cycles will vary in differing conditions including, but not limited to, freshwater or saltwater. The antifouling circuitry includes, but is not limited to, a software program. It is also within the scope of the invention to include antifouling chemicals in the injection molding process of components including, but not limited to; transparent lens 3 or transparent cover 2. Bright light and heat generated by underwater light 1 deters growth from attaching to transparent lens 3, transparent cover 2, and cooling surfaces of housing 10.

Underwater light 1 has smart circuitry (not shown) that can accept commands and communicate with a user through a series of light blinks or pauses between light blinks. The smart circuitry controls a power interrupt circuit (not shown) that powers a light emitting unit. A user can program the light to operate for a desired time span of each night by acknowledging a series of blinks from underwater light 1. Each series of blinks indicate an "on" period of time or an "off" period of time per day. The user acknowledges a series of blinks from underwater light 1 by powering "off" the light after the desired series of blinks. The smart circuitry accepts the command associated with the desired series of blinks prior to powering down. It is also within the scope of this invention for the user to cycle the power to the light, causing the smart circuitry to accept commands. For instance, a user could cycle the power "on" and "off" three times within thirty seconds, which would cause the smart circuitry to operate "on" twelve hours and "off" twelve hours each day. The smart circuitry can also monitor and communicate faults including, but not limited to, a high temperature condition and also shut down the light if it overheats. It can indicate overheating to a user through a series of flashes until a user rectifies the cause of overheating. Though the above methods of communicating are preferred embodiments, all methods of communicating through the power supplied to underwater light 1 and controlling other features are within the scope of the invention.

Figure 2:
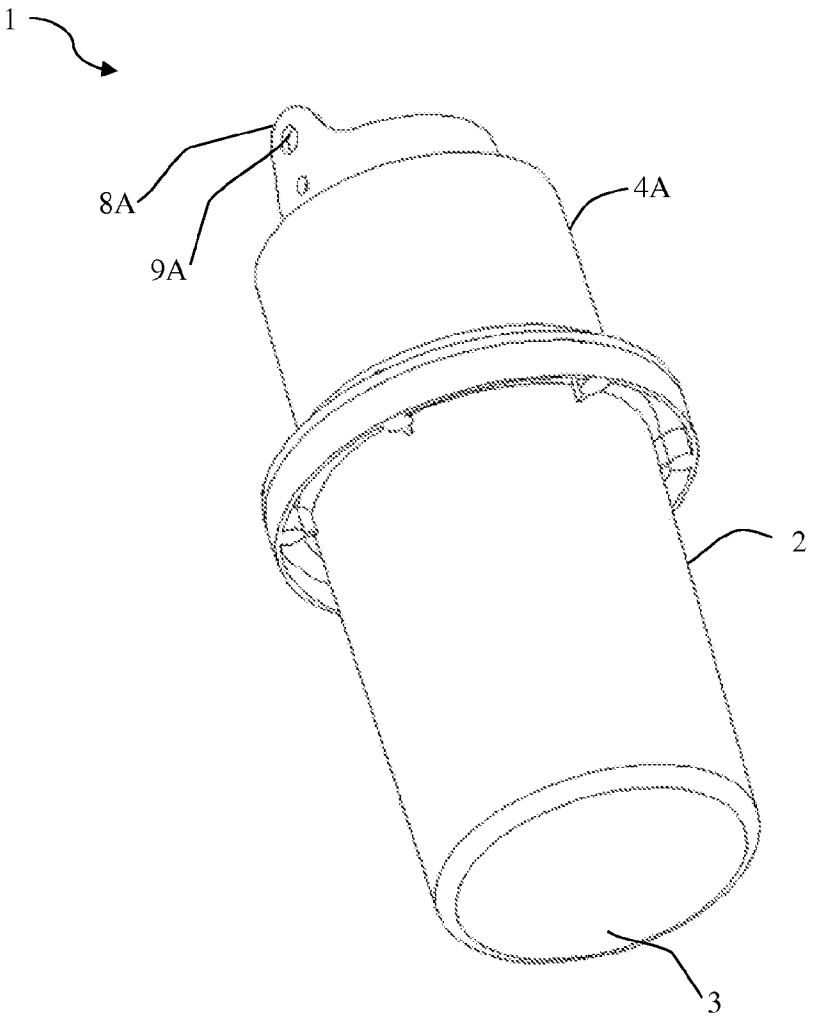
FIG. 2 is a front perspective view of the novel underwater light.

FIG. 2 shows transparent cover 2 is located opposite light fixture housing 4A and light fixture housing 4A can have a valve stem opening located thereon (not shown). Transparent cover 2 is positioned over a light bulb (not shown). FIG. 4. shows light fixture housing 4A having support surface 6 that receives a pliable support material (not shown) that surrounds the light bulb (not shown). The pliable support material is wider than the distance between the bulb and inner wall 4B of light fixture housing 4A, such that the pliable support material is compressed between the light bulb and inner wall 4B of the light fixture housing 4A. The pliable support material thus squeezes the light bulb to support the bulb. Additionally, the pliable support material is forced against inner wall 4B of light fixture housing 4A. The supporting of the light bulb aids in protecting the light bulb from breaking when underwater light 1 is tossed into the water. The squeezing of the light bulb also prevents the unscrewing from its socket due to the constant motion of currents. The pliable support material also creates a water tight barrier.

Transparent cover 2 is located opposite light fixture housing 4A. Transparent cover 2 is positioned over a light bulb. Transparent cover 2 has a support surface (not shown) that receives a pliable support material (not shown). The pliable support material is in contact with a portion of the bulb. The pliable support material is compressed between the light bulb and inner wall 4B of the light fixture housing 4A.

An alternate embodiment not shown of light fixture housing 4A is located opposite housing 10. Light fixture housing 4A has support surface 6 that receives a pliable support material (not shown). The pliable support material is in contact with port tube 40 (FIG. 8) of housing 10. The pliable support material is configured to be compressed between port tube 40 and inner wall 4B of light fixture housing 4A. The pliable support material forms a water tight seal between light fixture housing 4A and housing 10.

Figure 9:
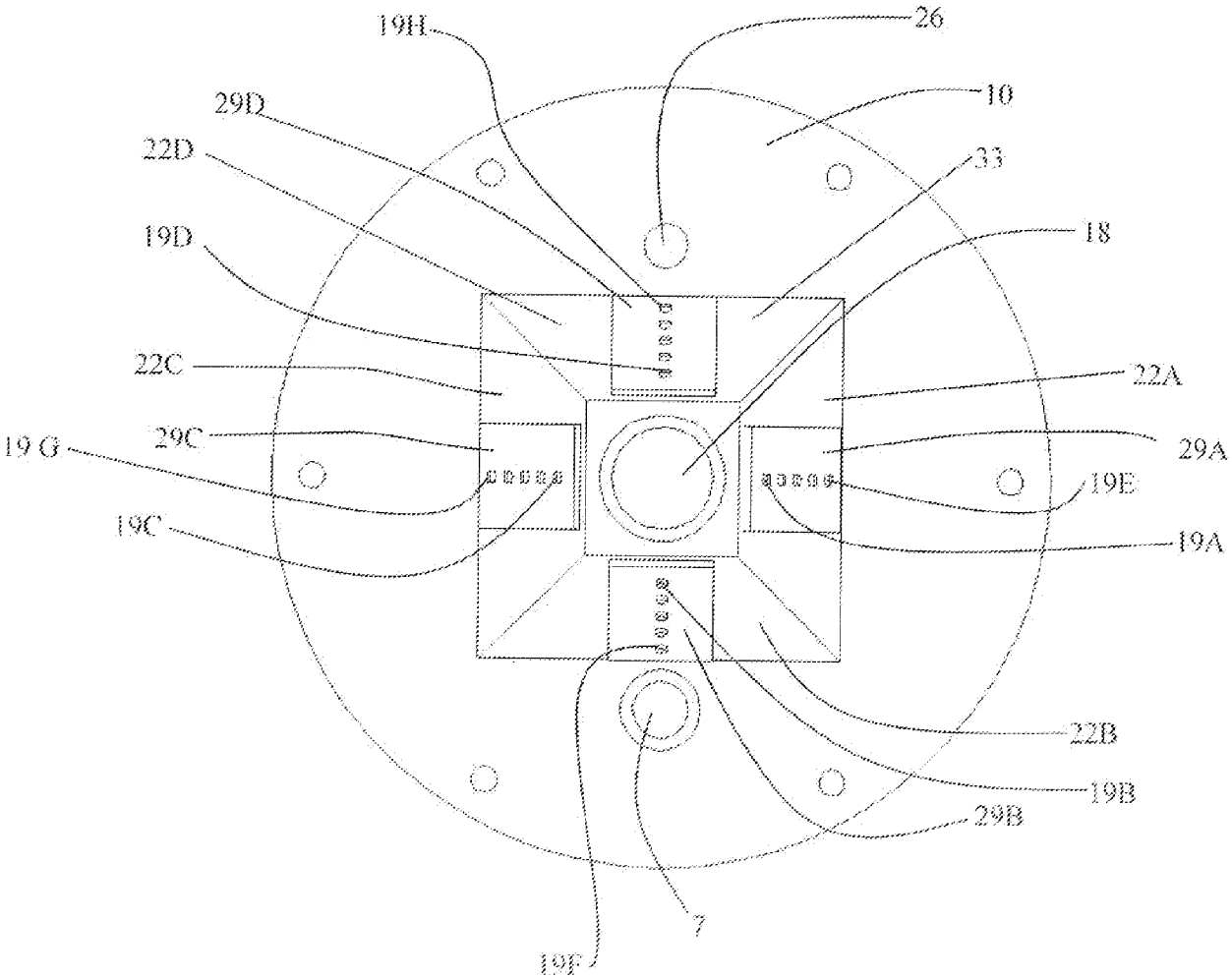
FIG. 9 is a top view of the thermally conductive housing.
Figure 24:
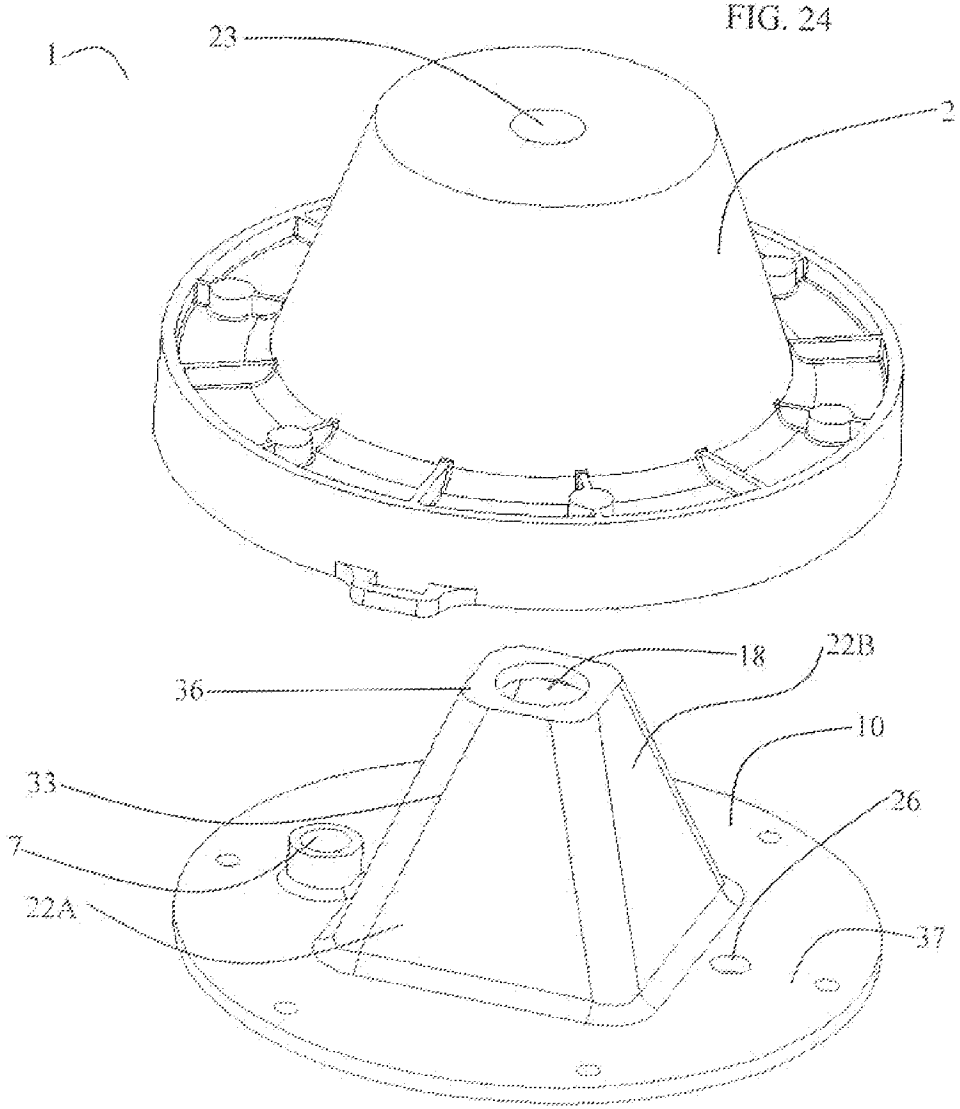
FIG. 24 is a top exploded view depicting an embodiment of the transparent cover and thermally conductive housing.

FIG. 24 shows transparent cover 2 is positioned over housing 10. Transparent cover 2 has support surface 6 that receives a pliable support material (not shown). The pliable support material is in contact with a portion of housing 10. The pliable support material is configured to be compressed between housing 10 and transparent cover 2. As shown in FIG. 25, housing 10 has chamber 31 formed from an interconnection of primary supporting surface 22A, secondary supporting surface 22B, tertiary supporting surface 22C (FIG. 9), and quaternary supporting surface 22D (FIG. 9). FIG. 9 shows each of supporting surfaces 22A, 22B, 22C, and 22D are formed on chamber wall secondary side 33.

Figure 8:
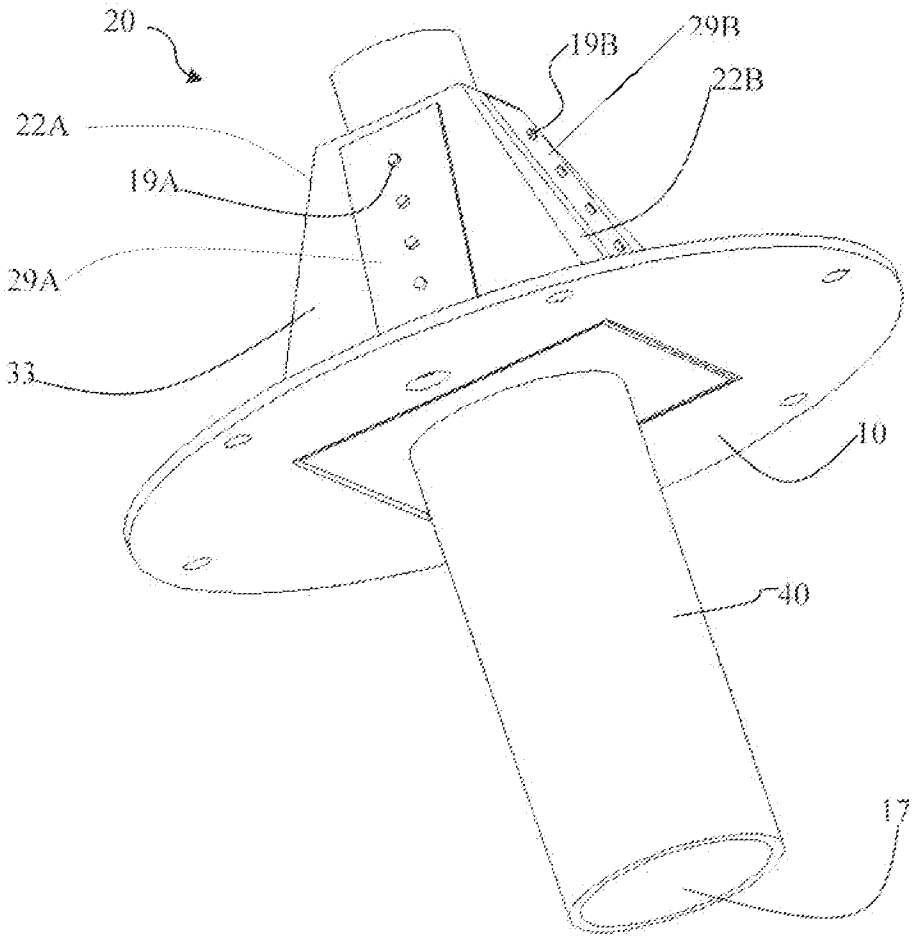
FIG. 8 is a rear perspective view of the internal cooling system.
Figure 21:
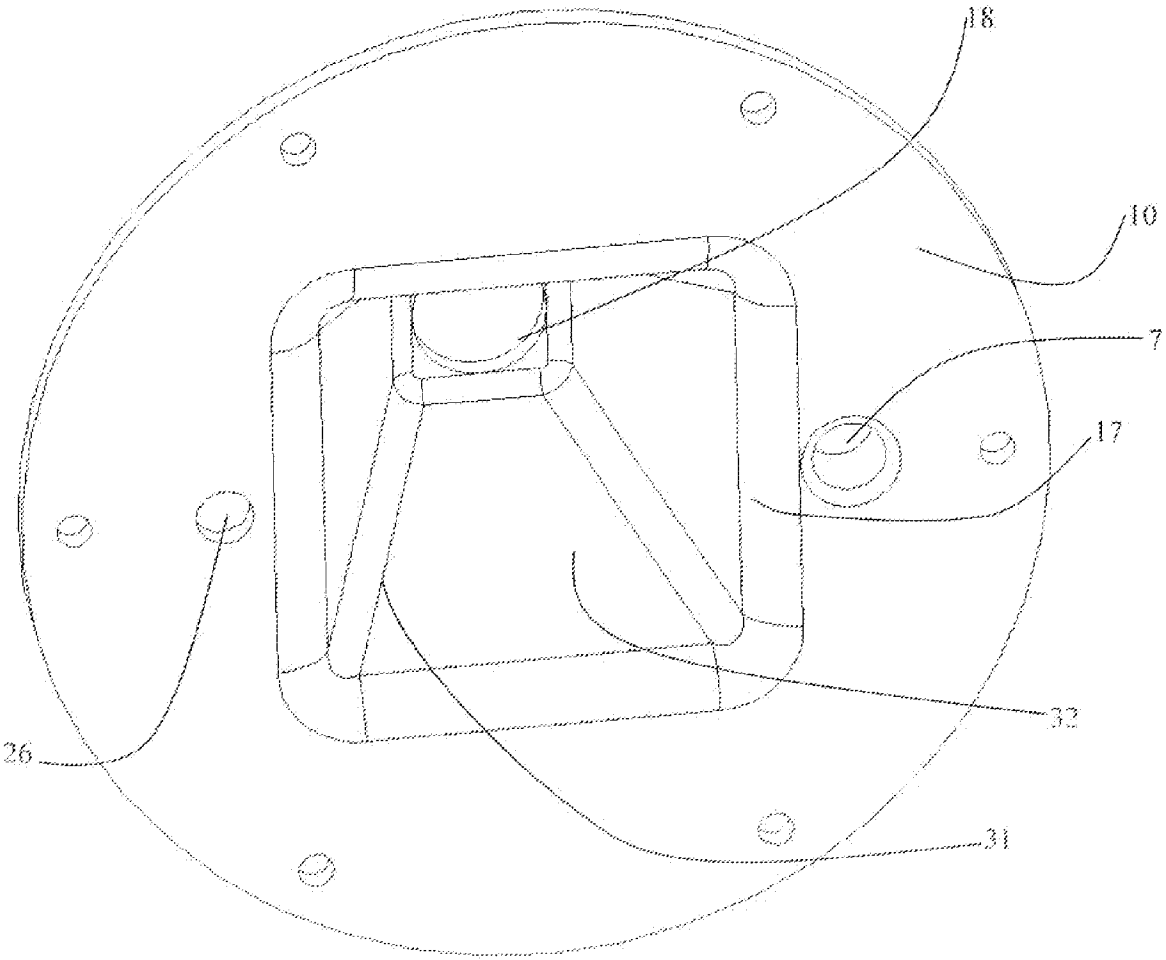
FIG. 21 is a perspective view depicting an embodiment of housing 10 having an opening at its base for water to enter chamber 31.
Figure 22:
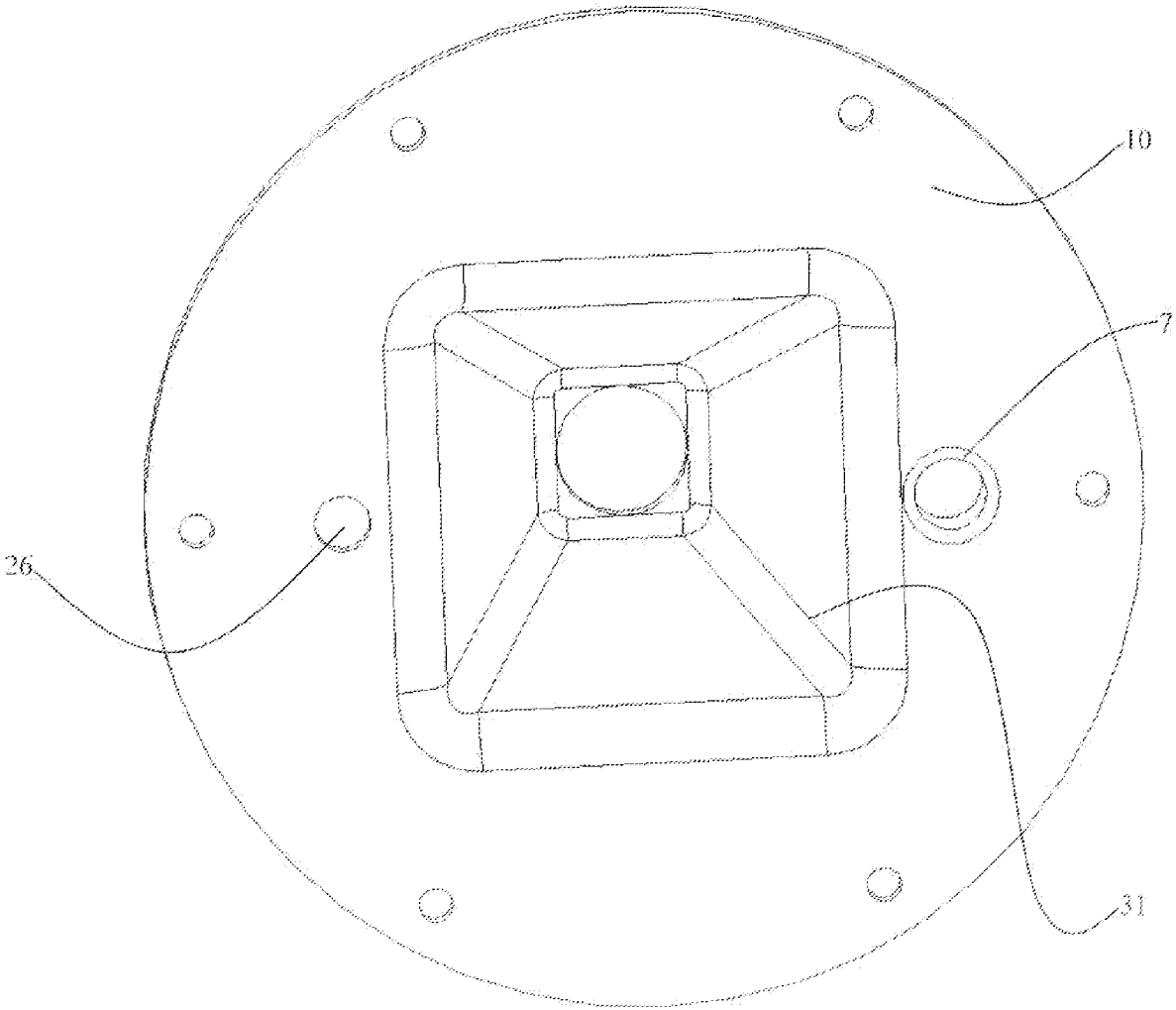
FIG. 22 is a rear perspective view depicting the thermally conductive housing.
Figure 26:
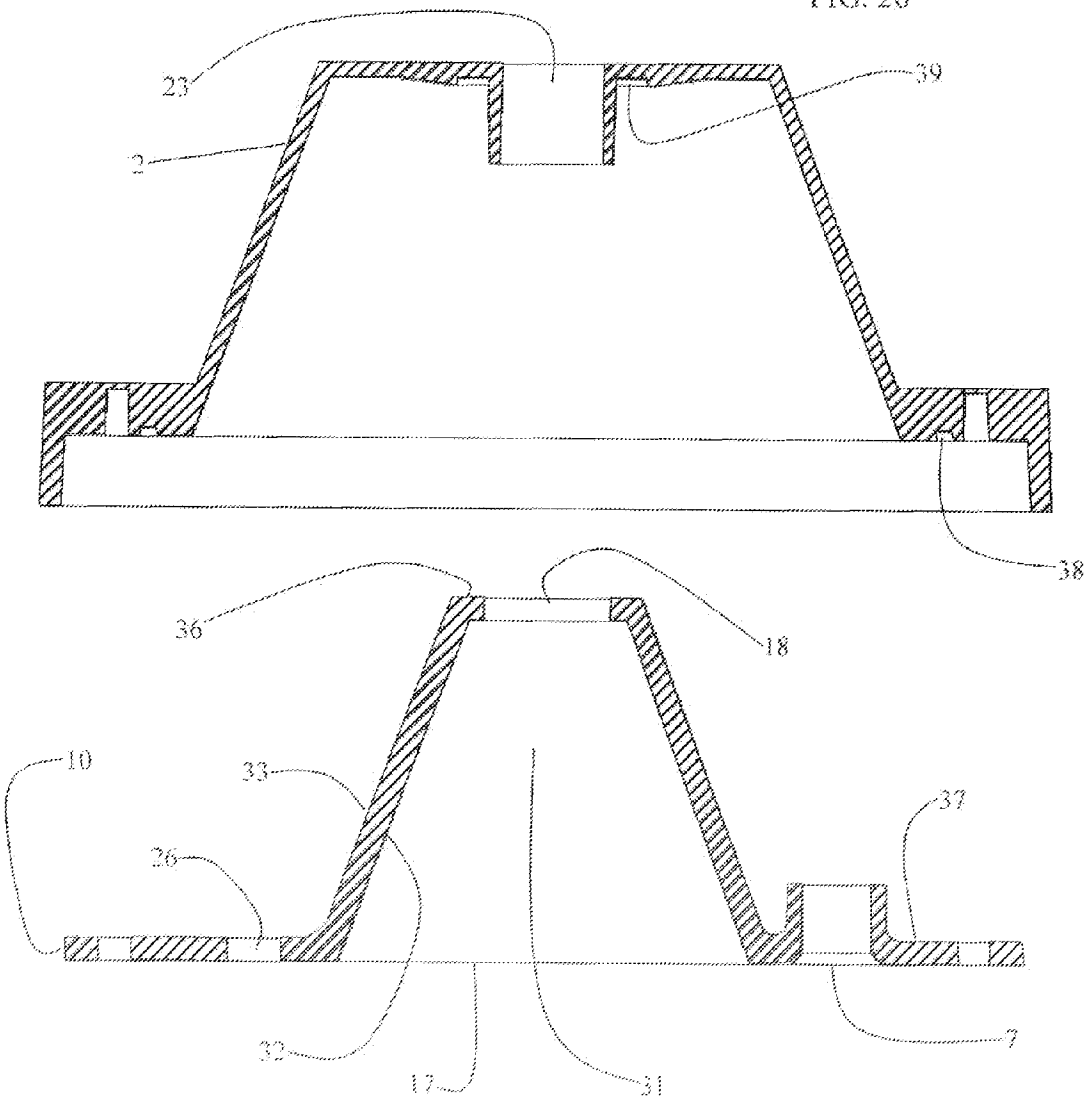

FIG. 8 shows internal cooling system 20 having housing 10 having primary chamber aperture 17 that is in direct contact with a surrounding water source. Primary chamber aperture 17 receives water and absorbs heat generated by light emitting units 19A and 19 B through chamber wall primary side 32 and chamber wall secondary side 33 as shown in FIG. 26. FIG. 21 depicts secondary chamber aperture 18 that expels heated water from chamber 31. Chamber 31 has a larger perimeter tapering to a smaller perimeter. Chamber 31 has primary chamber aperture 17 located on an end of chamber 31 that receives surrounding water of an ambient temperature. Primary chamber aperture 17 is configured to allow surrounding water to substantially fill chamber 31 and absorb heat from chamber 31 generated from light emitting units 19A, 19B, 19C, and 19D as shown in FIG. 9, sufficiently cooling light emitting units 19A, 19B, 19C, and 19D. FIG. 9 depicts each of supporting surfaces 22A, 22B, 22C, and 22D are in thermal communication with light emitting units 19A, 19B, 19C, and 19D generating heat. Each of supporting surfaces 22A, 22B, 22C, and 22D supports at least one light emitting unit.

Figure 5:
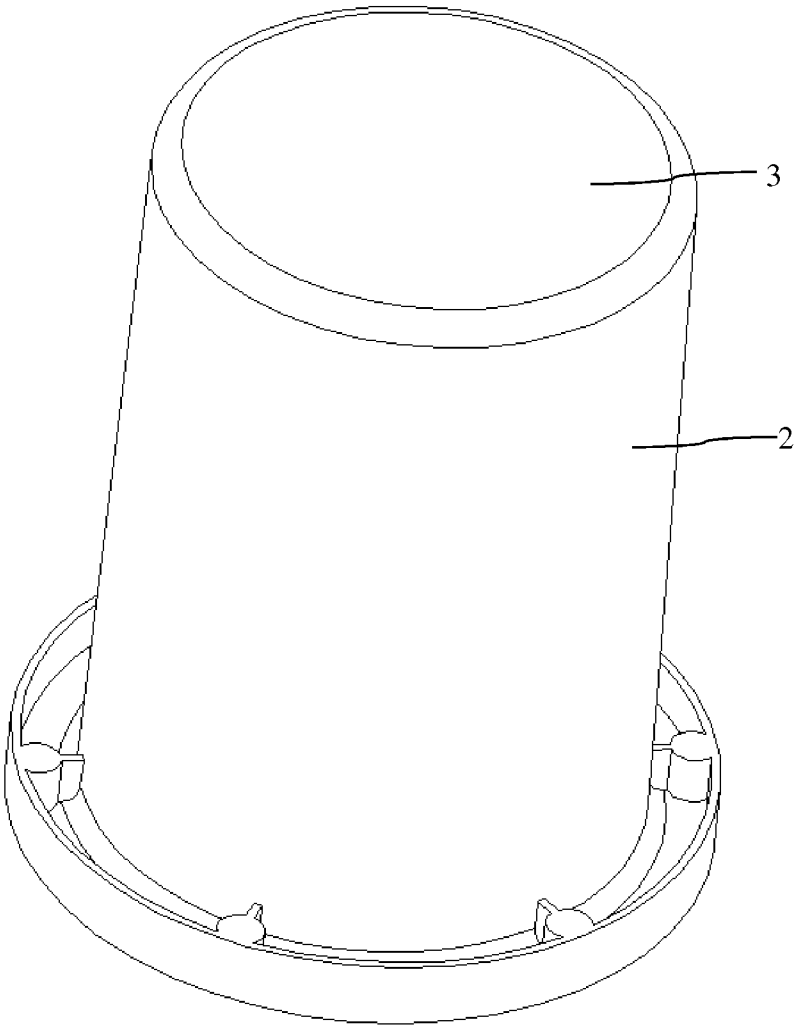
FIG. 5 is a perspective view of the transparent cover.

FIG. 5 depicts transparent cover 2 being a first color having a permanently attached transparent lens 3 of a second color positioned over a light emitting unit. Transparent cover 2 is a primary color, preferably clear. The end of transparent cover 2 has a transparent lens 3 being a secondary color including, but not limited to, blue or green. Transparent cover 2 illuminates an outer perimeter of water in a primary color and transparent lens 3 illuminates a central portion of the outer perimeter of water in a secondary color.

Figure 10:
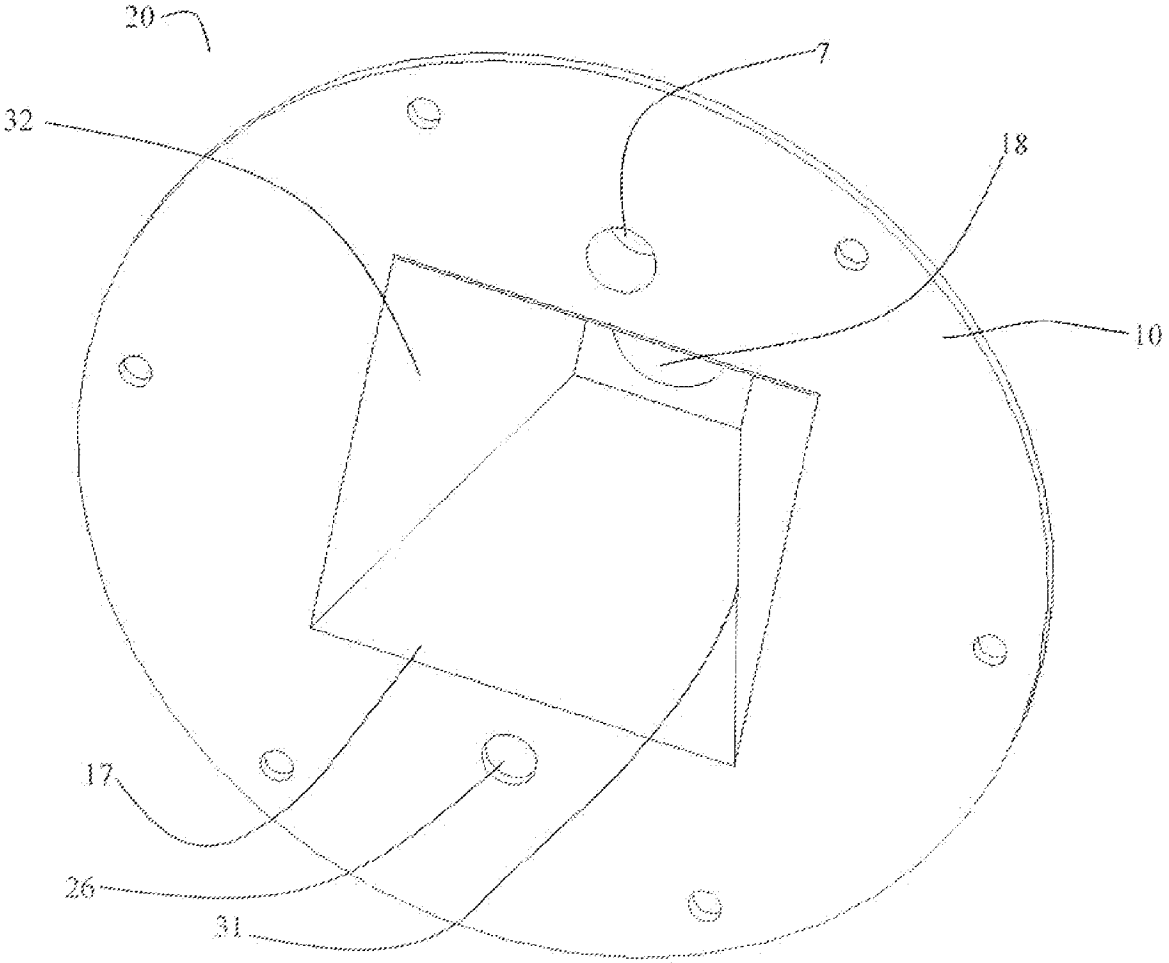
FIG. 10 is a rear perspective inside view of the thermally conductive housing chamber.
Figure 12:
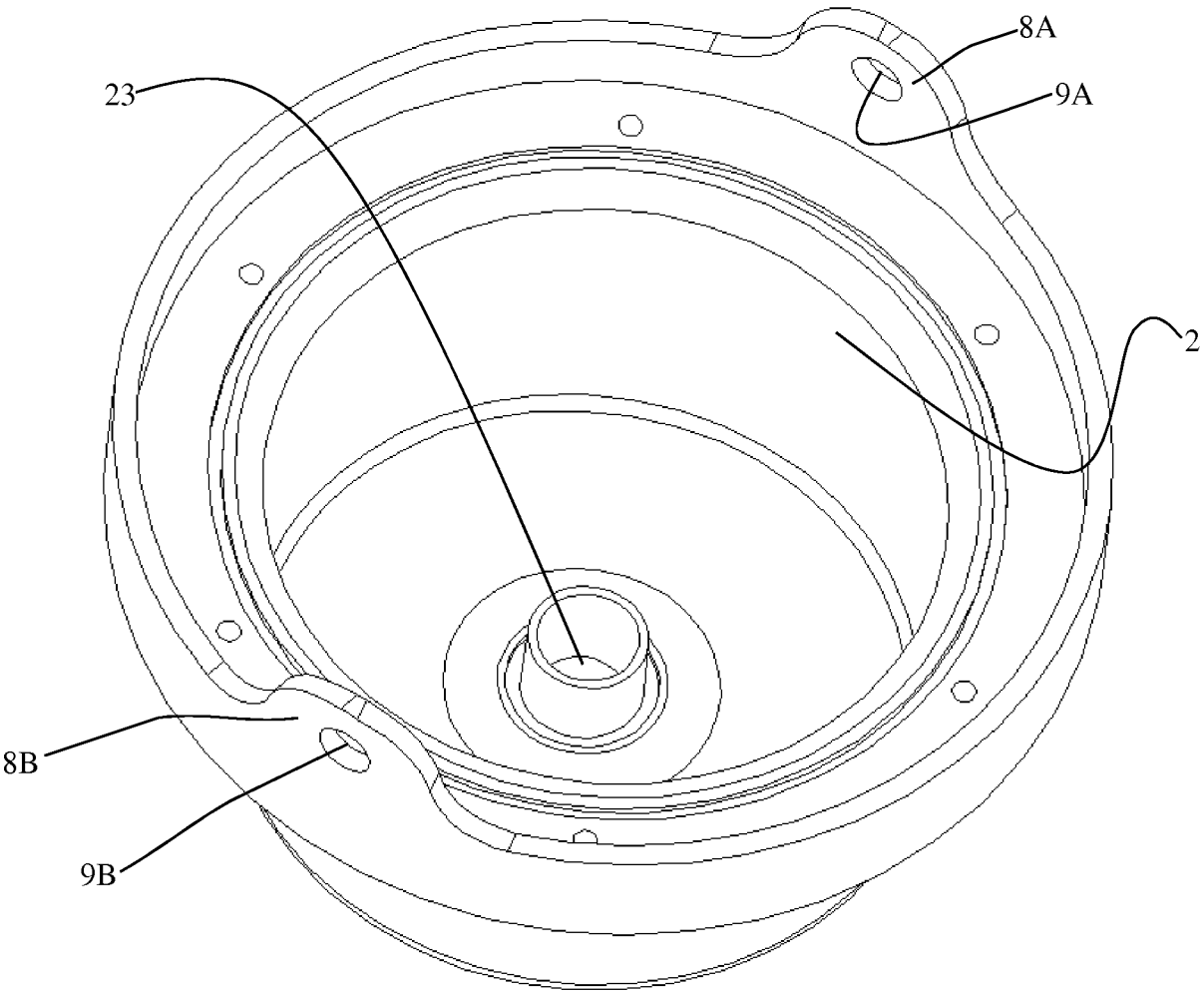
FIG. 12 is a rear perspective view of the transparent cover opening.

FIG. 10 shows housing 10 having secondary chamber aperture 18 located on an end of chamber 31 opposing primary chamber aperture 17. As shown in FIG. 26, chamber 31 of housing 10 is configured to allow surrounding water to flow through secondary chamber aperture 18 and transparent cover opening 23. FIG. 26 shows transparent cover 2 has a seal (not shown) between secondary O-ring channel 39 and primary O-ring mating surface 36 of housing 10. Transparent cover opening 23 is in hydro communication with primary chamber aperture 17 and secondary chamber aperture 18 of chamber 31. FIG. 12 shows transparent cover opening 23 configured to allow surrounding water to penetrate transparent cover 2 and transparent lens opening 25 (FIG. 15), allowing surrounding water to flow through secondary chamber aperture 18 and primary chamber aperture 17 as shown in FIG. 26. FIG. 26 also depicts housing 10 having chamber 31 with at least one wall having a chamber wall primary side 32 in contact with surrounding water. Chamber 31 has a supporting surface formed on a chamber wall secondary side 33 of at least one wall. The chamber wall secondary side 33 of at least one wall is located opposite the chamber wall primary side 32 of at least one wall. At least one light emitting unit is supported by the supporting surface. Chamber wall primary side 32 of at least one wall is in thermal communication with at least one light emitting unit and heat is transferred from at least one light emitting unit to the surrounding water.

Figure 14:
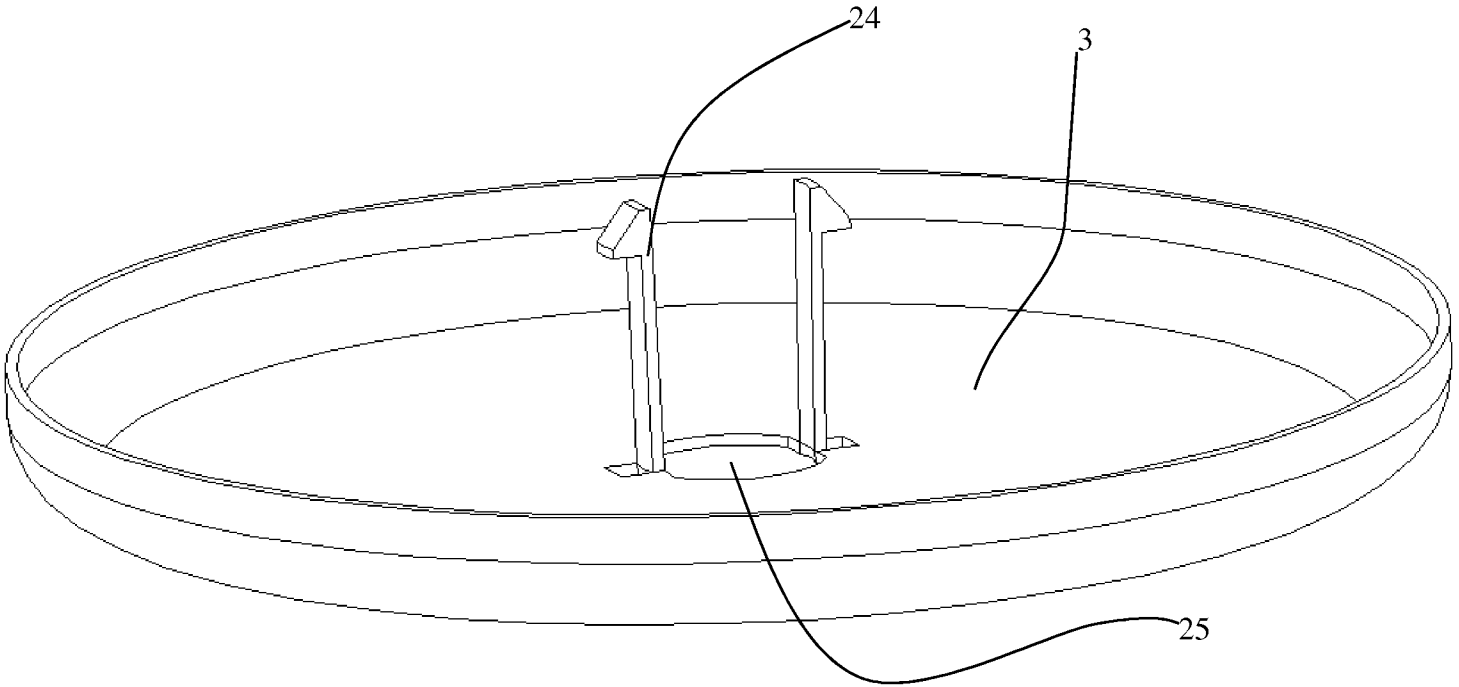
FIG. 14 is a side perspective view of the latching structure of the transparent lens.

FIG. 14 depicts transparent lens 3 having transparent lens opening 25 and transparent lens latching structure 24 configured to connect transparent lens 3 to the end of transparent cover 2 (FIG. 24). Transparent cover opening 23 (FIG. 24) of transparent cover 2 receives transparent lens latching structure 24 of transparent lens 3. Transparent lens latching structure 24 is located on the surface of transparent lens 3 facing transparent cover 2 and is received by transparent cover opening 23 positioned over a light emitting unit. Transparent cover opening 23 receives and captures transparent lens latching structure 24. Transparent lens latching structure 24 includes, but is not limited to; having at least one barbed latching structure. It is also within the scope of the invention for transparent cover 2 to have latching structure 24 captured by transparent lens 3. Transparent lens 3 can have a different color that is permanently fixed to the end of transparent cover 2.

FIG. 12 shows transparent cover 2 having two attaching structures 8A and 8B located on the end of transparent cover 2. The two attaching structures 8A and 8B each have one attaching structure opening 9A and 9B to receive an attaching element. The attaching element includes, but is not limited to; a rope, tie strap, tether, or a chain. An alternate embodiment not shown includes two attaching structures 8A and 8B are located outboard of the perimeter of a primary chamber aperture 17 receiving surrounding water. The attaching element is connected to an anchor configured to suspend underwater light 1 in a vertical orientation when submerged in a body of water.

Transparent cover 2 has a single attaching structure (not shown) bridging the perimeter of a primary chamber aperture 17 receiving surrounding water. The single attaching structure is configured to receive an attaching element connected to an anchor and to suspend underwater light 1 in a vertical orientation when submerged in a body of water. Underwater light 1 displaces a volume of water causing it to be buoyant.

Housing 10 has a single attaching structure (not shown) bridging the perimeter of a primary chamber aperture 17 receiving surrounding water. The single attaching structure is configured to suspend underwater light 1 in a vertical orientation when submerged in a body of water. The single attaching structure receives an attaching element connected to an anchor.

An alternate embodiment not shown includes housing 10 having two attaching structures 8A and 8B located on an end of housing 10. The two attaching structures 8A and 8B are configured to suspend underwater light 1 in a body of water. Attaching structures 8A and 8B are each located outboard of the perimeter of a primary chamber aperture 17 receiving surrounding water. The two attaching structures 8A and 8B each have one attaching structure opening 9A and 9B to receive an attaching element.

FIG. 24 depicts housing 10 having valve stem opening 26 to accommodate a tire valve stem (not shown) capable of removing or filling underwater light 1 with a gas. A user has the ability to remove air from the inside of underwater light 1 and to fill underwater light 1 with an inert gas. This prevents water droplets from condensation and building up on the inside surfaces of underwater light 1, causing damage to circuitry inside the light. Internal pressure from within the light also aids in leak detection and leak prevention.

Figure 7:
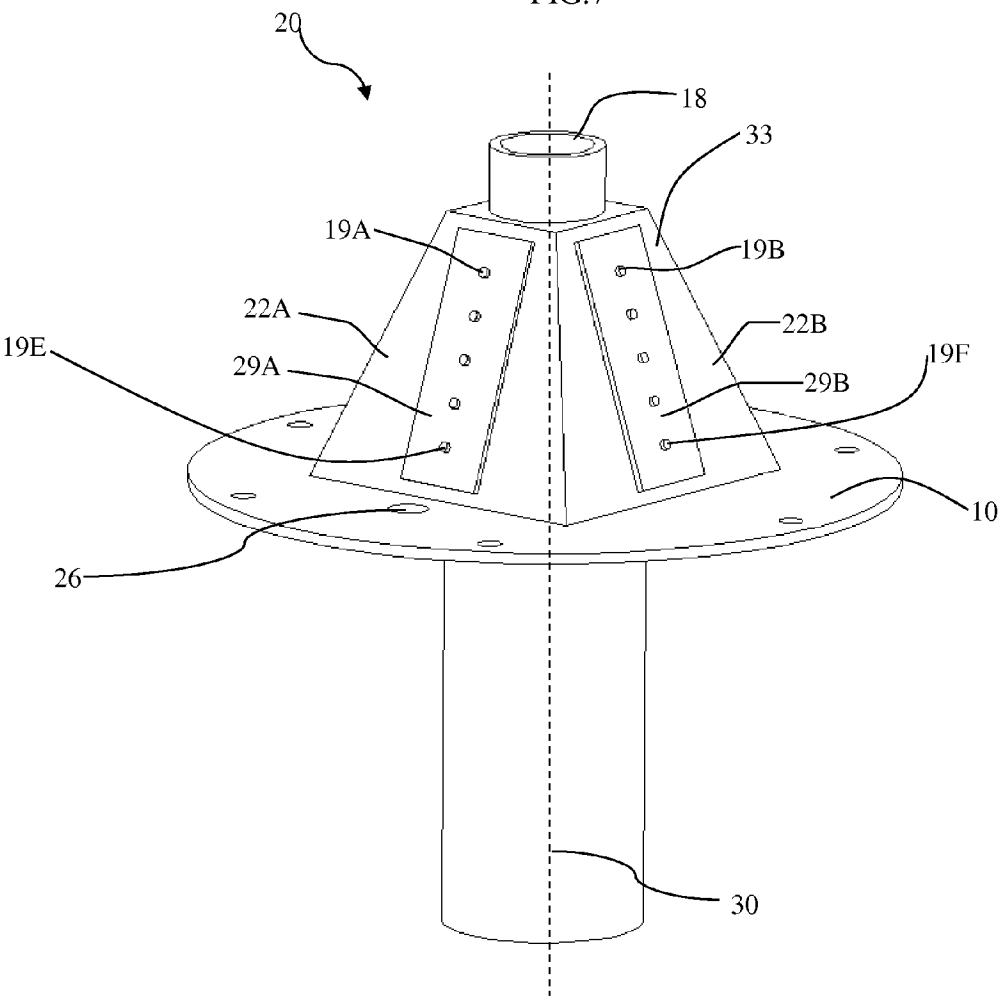
FIG. 7 is a perspective view of the internal cooling system.

FIG. 9 depicts four supporting surfaces 22A, 22B, 22C, and 22D each support two light emitting units 19 A and 19 E, 19B and 19F, 19C and 19G, 19D and 19H. Each of supporting surfaces 22A, 22B, 22C, and 22D support a primary light emitting unit of a primary color 19A, 19B, 19C, and 19D and a secondary light emitting unit of a secondary color 19E, 19F, 19G, and 19H. FIG. 7 shows primary light emitting unit of a primary color 19A and 19B and secondary light emitting unit of a secondary color 19E and 19F are oriented in an upper and lower position related to central axis 30 of internal cooling system 20.

Figure 23:
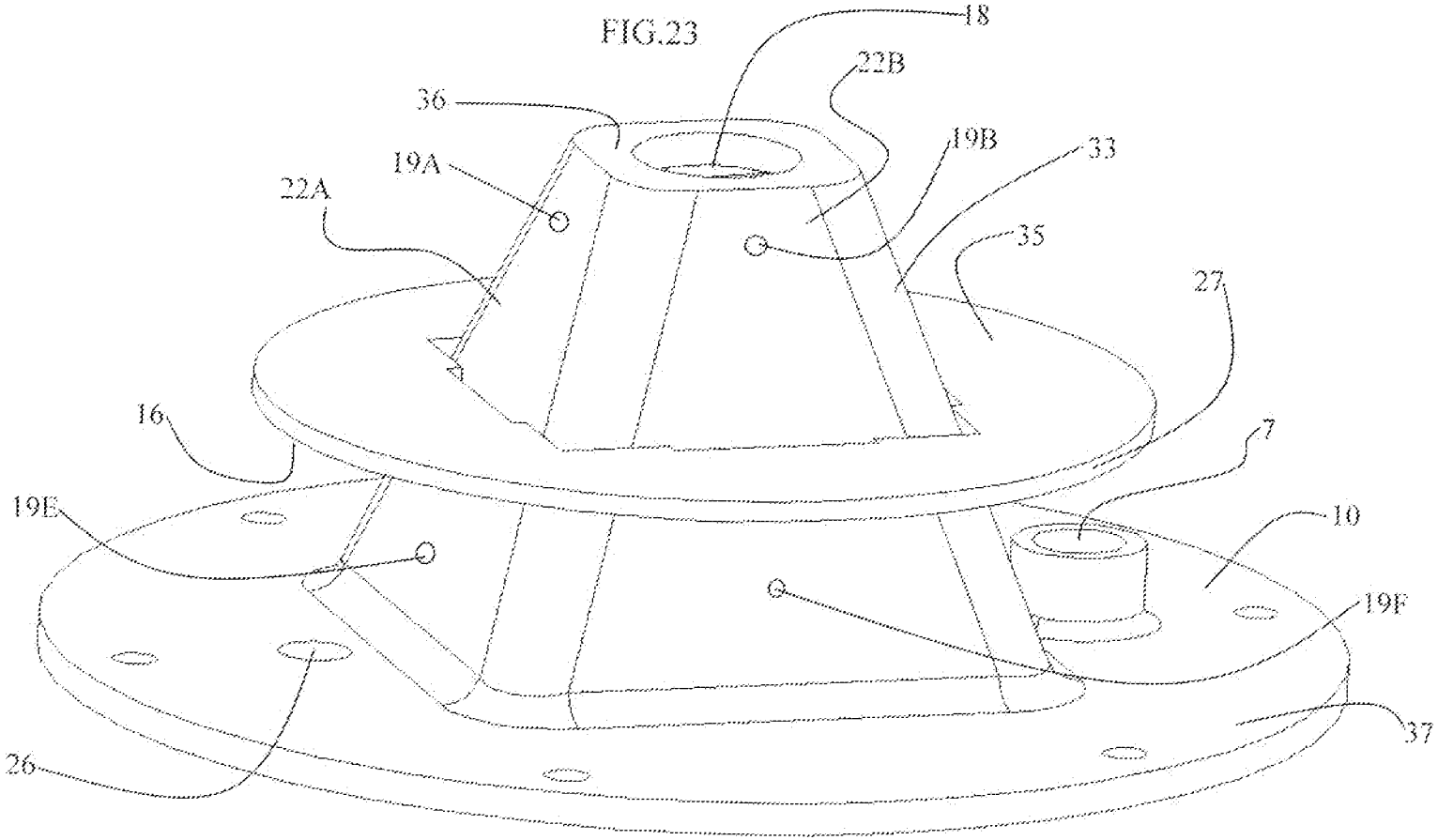
FIG. 23 is a perspective view depicting an embodiment of the thermally conductive housing having a light bifurcating structure.

As shown in FIG. 23, housing 10 has light bifurcating structure 27 having light bifurcating structure primary surface 35 located opposite light bifurcating structure secondary surface 16. Light bifurcating structure 27 is positioned between primary light emitting unit of a primary color 19A, 19B, 19C (FIG. 9), and 19D (FIG. 9) and secondary light emitting unit of a secondary color 19E, 19F, 19G (FIG. 9), and 19H (FIG. 9). Light bifurcating structure 27 extends from a point substantially related to or connected to a surface supporting a primary light emitting unit of a primary color and a secondary light emitting unit of a secondary color. Light bifurcating structure 27 extends away from the point of contact of primary light emitting units of a primary color 19A, 19B, 19C, and 19D and secondary light emitting units of a secondary color 19E, 19F, 19G, and 19H extends to a point where light bifurcating structure 27 obstructs at least a portion of light from primary light emitting units of a primary color 19A, 19B, 19C, and 19D and a portion of light from secondary light emitting units of a secondary color 19E, 19F, 19G, and 19H. Light bifurcating structure 27 causes an outer perimeter of water to illuminate in a primary color and a central portion of water to illuminate in a secondary color. An electrical cord (not shown) is provided to be in electrical communication with light emitting units through power cord inlet 7 located on housing 10. The electrical cord is connected to a power source.

Transparent cover 2 is located over housing 10. Housing 10 is constructed of a thermally conductive material. FIG. 7 describes housing 10 having primary supporting surface 22A at an angle between 0 degrees and 85 degrees in relation to central axis 30 of underwater light 1 (FIG. 24). Housing 10 has secondary supporting surface 22B at an angle between 0 degrees and 85 degrees in relation to central axis 30 of underwater light 1. Housing 10 has tertiary supporting surface 22C (FIG. 9) at an angle between 0 degrees and 85 degrees in relation to central axis 30 of underwater light 1. Housing 10 has quaternary supporting surface 22D (FIG. 9) at an angle between 0 degrees and 85 degrees in relation to central axis 30 of underwater light 1. The optimal supporting surface angle is approximately 20 degrees in relation to central axis 30 of underwater light 1. The angle range between 0 degrees and 85 degrees is to achieve a varying perimeter of light radiating from underwater light 1. FIG. 9 depicts primary supporting surface 22A, secondary supporting surface 22B, tertiary supporting surface 22C, and quaternary supporting surface 22D are each in thermal contact with light emitting units generating heat.

Primary supporting surface 22A, secondary supporting surface 22B, tertiary supporting surface 22C, and quaternary supporting surface 22D are configured to form chamber 31 having a large diameter primary chamber aperture 17 located on one end of chamber 31. As shown in FIG. 10, chamber 31 has a smaller diameter secondary chamber aperture 18 located at the opposite end of chamber 31. Primary chamber aperture 17 receives surrounding water of an ambient primary temperature. One opening located at the end of chamber 31 has a diameter at least 10 percent larger or smaller than the opening located at the opposite end of chamber 31. Depending on how tall chamber 31 is, the diameter of the larger opening will become exponentially larger as chamber 31 lengths are increased. As water absorbs the heat radiated from light emitting units, secondary chamber aperture 18 expels surrounding water from inside chamber 31 at a secondary temperature greater than the ambient primary temperature. Secondary chamber aperture 18 expelling heated water is determined by the orientation of underwater light 1. Since hot water rises, the end of chamber 31 pointing toward the surface will generally expel the heated water.

Transparent cover 2 is located over housing 10. Housing 10 is constructed of a thermally conductive material. Housing 10 has primary supporting surface 22A at an angle between 0 degrees and 85 degrees in relation to central axis 30 of underwater light 1. Housing 10 has secondary supporting surface 22B at an angle between 0 degrees and 85 degrees in relation to central axis 30 of underwater light 1. Housing 10 has tertiary supporting surface 22C at an angle between 0 degrees and 85 degrees in relation to central axis 30 of underwater light 1. The optimal supporting surface angle is approximately 20 degrees in relation to central axis 30 of underwater light 1. Primary supporting surface 22A, secondary supporting surface 22B, and tertiary supporting surface 22C are each in thermal contact with a light emitting unit generating heat. Housing 10 can be configured to have or not have chamber 31. All though not as efficient, housing 10 can be constructed primarily as a solid structure with a surface exposed to surrounding water. Housing 10 could also be constructed of a solid outer surface with its core filled with a thermally conductive material.

FIG. 25 depicts a method of constructing underwater light 1 to enable a cooling operation between housing 10 and a surrounding water source. Housing 10 is provided and has a plurality of supporting surfaces each being at an angle between 0 degrees and 85 degrees in relation to central axis 30 (FIG. 7) of underwater light 1. A plurality of light emitting units are attached to the plurality of supporting surfaces. The plurality of supporting surfaces are located on chamber wall secondary side 33 that is not in contact with water. Transparent cover 2 is provided to enclose the portion of housing 10 having the plurality of supporting surfaces. FIG. 21 shows chamber wall primary side 32 of housing 10 which is in contact with surrounding water. The surrounding water sufficiently cools light emitting units.

These embodiments are illustrative of the invention and are not exhaustive thereof. As underwater light manufacturers add additional or different structures, still further structures may be required in future embodiments of the invention but all such future embodiments are within the scope of this invention.

For example, underwater light 1 may have only one attaching structure (not shown). Thus, the single attaching structure would bridge an end of housing 10 having primary chamber aperture 17 to accommodate an attaching element.

Underwater light 1 having two attaching structures 8A and 8B located on an end of housing 10 each have at least one attaching structure opening 9A and 9B to receive an attaching element. The attaching element includes, but is not limited to; a tether, tie strap, rope, or a chain, including, but not limited to being; tied, clipped, or snapped to attaching structure openings 9A and 9B.

Thus, attaching structures 8A and 8B will connect with all currently known attaching elements and in view of this disclosure any future changes in attaching structures 8A and 8B can be met.

Moreover, as mentioned, each embodiment of the illustrative embodiments will accommodate novel internal water cooling system 20, regardless of the number of supporting surfaces and configuration of housing 10 therein. In order to form chamber 31 having angled supporting surfaces, there must be at least three supporting surfaces 22A, 22B, and 22C. Although, not preferred, a cone shape without a flat supporting surface would also accommodate a plurality of supporting surfaces at an angle between 0 degrees and 85 degrees in relation to central axis 30 of underwater light 1 and also provide chamber 31.

For instance, FIG. 26 shows housing 10 with chamber 31 having primary chamber aperture 17 located at the base end of chamber 31 and an opposite secondary chamber aperture 18 located at the peak end of chamber 31, will incorporate internal water cooling system 20 (FIG. 8). Surrounding water flows through chamber 31 by entering through primary chamber aperture 17. Surrounding water contacts chamber wall primary side 32 and absorbs heat generated by light emitting units attached to chamber wall secondary side 33. Heated water is expelled through secondary chamber aperture 18.

Although, not as effective as internal water cooling system 20, a solid housing 10 not having chamber 31 will have a water cooling effect in which surrounding water comes into contact with an exposed surface of housing 10. This surface will be in thermal communication with light emitting units generating heat. The surrounding water will absorb heat from housing 10's surface in contact with surrounding water.

In addition to the aforesaid embodiments of chamber 31 of housing 10, light fixture housing 4A includes multiple additional improvements as well.

A first improvement as shown in FIG. 3 is of light fixture housing 4A having an integrally formed sealing structure 5 located opposite of a light emitting unit (not shown). Sealing structure 5 has an area for resin to contact two opposing surfaces: primary sealing surface 11 and secondary sealing surface 12 (FIG. 4). An electrically conductive element is adapted to penetrate secondary sealing structure opening 21 from a point external of light fixture housing 4A. When resin is applied to primary sealing structure opening 13 and secondary sealing structure opening 21, primary cavity 14 at the base end of light fixture housing 4A becomes filled with resin and primary sealing surface 11 is contacted by the resin. As shown in FIG. 4, secondary cavity 15 at the peak end of light fixture 4A housing becomes filled with resin and secondary sealing surface 12 becomes surrounded by the resin. When the resin hardens to a solid state, it tightens around primary sealing surface 11 and secondary sealing surface 12 while pulling away from inner wall 4B of light fixture housing 4A.

The electrically conductive element and sealing structure 5 are permanently sealed from an external water source.

A second improvement of light fixture housing 4A is shown in FIG. 3 and has a primary sealing structure opening 13 to accept an electrically conductive element including, but not limited to, a light bulb, light socket, or an electrical cord. Light fixture housing 4A has a secondary sealing structure opening 21 located at the base end of light fixture housing 4A accepts an electrically conductive element including, but not limited to: an electrical cord.

A third improvement as shown in FIG. 10 includes internal water cooling system 20. Housing 10 has chamber 31 that receives surrounding water at a primary ambient temperature through primary chamber aperture 17 located on the base end of chamber 31. The water enters chamber 31 through primary chamber aperture 17 and cools the LEDs by absorbing heat generated by the LED's through chamber wall primary side 32 of housing 10. The water exits the chamber through secondary chamber aperture 18 located at the peak end of chamber 31 at a secondary temperature greater than the ambient water primary temperature. By overdriving the LED's, a substantially brighter light is produced without risk of damaging the LEDs due to the efficiency of water cooling. It is also envisioned to have the peak of chamber 31 point opposite the surface of the water to illuminate toward including, but not limited to, the sea floor or a reservoir bottom. It is also envisioned to have underwater light 1 in a horizontal position having water forced through chamber 31 due to movement of a water vehicle or water pump.

A fourth improvement of internal water cooling system 20 as shown in FIG. 10 has primary chamber aperture 17 accepting surrounding water. The water then flows into chamber 31 where it comes into contact with chamber wall primary side 32 of housing 10 and absorbs heat generated from a light emitting unit. The greater temperature water rises and exits chamber 31 from secondary chamber aperture 18.

Another improvement produces a large diameter of light in shallow water. Housing 10 has at least three LED circuit board supporting surfaces each configured at an angle between 0 degrees and 85 degrees in relation to central axis 30 of underwater light 1 when suspended vertically underwater from an end of underwater light 1 opposite transparent cover 2. This configuration allows the light from the LEDs to radiate outward and upward from underwater light 1 to produce a large diameter of light.

Underwater light 1 is further improved as shown in FIG. 2 by transparent cover 2 being a primary color and having transparent lens 3 located at the distal end of transparent cover 2 being a secondary color. Transparent cover 2 illuminates an outer perimeter of water in a primary color while transparent lens 3 illuminates a central portion of the water in a secondary color. This multi-color effect both attracts marine life and is esthetically pleasing to spectators.

The transparent cover 2 is clear with white LED's and transparent lens 3 has a color other than clear. Marine life is attracted to the colored center beam of light and the white perimeter lighting illuminates the surrounding water for vivid visibility of marine life.

FIG. 4 shows an improved support surface 6 is formed on inner wall 4B of light fixture housing 4A located opposite transparent cover 2 (FIG. 1) which is positioned to cover a light bulb (not shown). This support surface 6 receives a pliable support material (not shown) including, but not limited to; foam or rubber. The pliable support material is in contact with a portion of a light bulb to prevent any shifting of the light bulb and also to create a seal to prevent water from entering light fixture housing 4A. The pliable support material is configured to be compressed between a light bulb and an inner wall 4B of light fixture housing 4A.

Support surface 6 has a location on transparent cover 2 that provides a surface for a pliable support material configured to be compressed between a light bulb and transparent cover 2 (not shown).

Support surface 6 has a location on transparent cover 2 positioned over housing 10. The pliable support material is configured to be compressed between housing 10 and an inner wall 4B of light fixture housing 4A (not shown).

Support surface 6 has a location on transparent cover 2 positioned over housing 10. The pliable support material is configured to be compressed between housing 10 and inner wall of transparent cover 2 (not shown).

An important object of this invention is to provide underwater light 1 with the use of high powered LEDs by utilizing internal water cooling system 20 to absorb excessive heat. This heat absorption enables a stable environment for the LEDs to be overdriven and creates superior light penetration underwater.

Another important object is to provide a permanently water tight sealing structure 5 that allows a hardened resin to tighten to opposing surfaces of primary sealing surface 11 and secondary sealing surface 12 (FIGS. 3 and 4).

FIG. 26 illustrates an improved housing 10 eliminates the need for light fixture housing 4A. Housing 10 has a wider base that comes into contact with transparent cover 2 and is sealed by an O-ring or sealant in primary O-ring channel 38 that mates with secondary O-ring mating surface 37 of housing 10. FIG. 25 shows housing 10's base has openings to receive fasteners including, but not limited to screws or rivets. Housing 10's base has a power cord inlet 7 to receive an electrically conductive element. Housing 10 may have chamber 31 with one or two openings for internal cooling system 20 (FIG. 8) or a structure with no opening (not shown) for a cooling system that transfers heat when surrounding water comes into contact with an exposed surface of housing 10.

Additional objects include, but are not limited to, the provision of underwater light 1 having an improved support surface 6 with a pliable support material, a plurality of circuit boards supporting light emitting units mounted on housing 10's chamber wall secondary side 33 at an angle between 0 degrees and 85 degrees from central axis 30 to increase the perimeter of light emitted, an improved transparent cover 2 being a primary color having transparent lens 3 of a secondary color, a higher intensity light emitted providing improved light penetration underwater due to ultra-efficient water cooling of LEDs, light bifurcating structure 27 that is positioned between a set of LED's of a primary color and a set of LED's of a secondary color, antifouling circuitry (not shown) that deters growth from attaching to underwater light 1, smart circuitry (not shown) that can communicate faults and settings to a user through multiple combinations of blinks from underwater light 1, and valve stem opening 26 to add a gas to or remove a gas from underwater light 1.

These and other important objects, advantages, and features of the invention will become clear as this description proceeds.

The invention accordingly comprises the features of construction, combination of elements, and arrangement of parts that will be exemplified in the description set fourth hereinafter and the scope of the invention will be indicated in the claims.

Construction of the Novel Underwater Light

Referring now to FIGS. 1 and 2, it will be seen that the reference numeral 1 denotes an illustrative embodiment of novel underwater light 1 as a whole. Novel underwater light 1 is assembled by interconnecting transparent cover 2 and light fixture housing 4A. Transparent lens 3 (FIG. 2) is located at a distal end of transparent cover 2. FIGS. 1-2 illustrate each attaching structures 8A and 8B each having an attaching structure opening 9A and 9B. Specifically, as suggested by the alignment of parts in FIG. 4, support surface 6 receives a pliable support material (not shown) which is compressed between light bulb (not shown) and inner wall 4B of light fixture housing 4A.

Referring again to FIG. 4, light fixture housing 4A has a sealing structure 5 with a secondary sealing surface 12 located opposite primary sealing surface 11(FIG. 3). Secondary sealing surface 12 is located adjacent to second cavity 15. FIG. 3 shows primary sealing surface 11 is located adjacent to primary cavity 14. Sealing structure 5 has primary sealing structure opening 13 and secondary sealing structure opening 21. Alternatively, novel underwater light 1 can be assembled using an internal cooling system 20 (FIG. 8). For example primary sealing structure opening 13 (FIG. 3) accommodates port tube 40 (FIG. 8).

Figure 6:
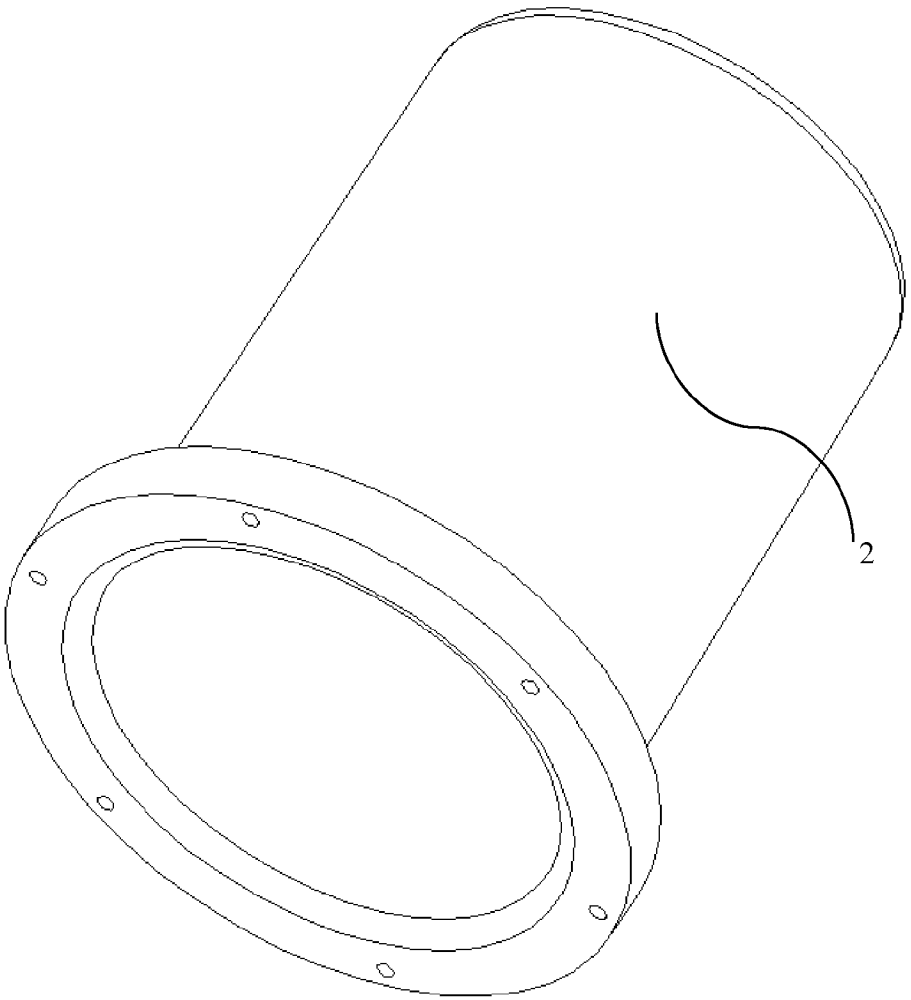
FIG. 6 is a rear perspective view of the transparent cover.

In FIGS. 2 and 5, transparent lens 3 is part of the distal end of transparent cover 2 (FIG. 6).

Internal Liquid Cooling System 20: As shown in FIG. 7, internal liquid cooling system 20 has housing 10 constructed of a plurality of supporting surfaces 22A, 22B, 22C (FIG. 9), and 22D (FIG. 9) and has central axis 30. Valve stem opening 26 is located on housing 10. Chamber 31 (FIG. 10) has chamber wall secondary side 33 that is in contact with circuit boards 29A and 29B. Secondary chamber aperture 18 expels heated water. FIGS. 7 and 9 illustrate supporting surface 22A is in thermal contact with circuit board 29A connected to light emitting unit 19A and 19E generating heat. Mounting surface 22B is in thermal contact with circuit board 29B connected to light emitting unit 19B and 19F generating heat. FIG. 9 shows supporting surface 22C is in thermal contact with circuit board 29C connected to light emitting unit 19C and 19G generating heat. Supporting surface 22D is in thermal contact with circuit board 29D having a light emitting unit 19D and 19H generating heat. Housing 10 has power cord inlet 7 connected to a power cord (not shown) and valve stem opening 26 connected to a valve stem (not shown). FIG. 10 illustrates primary chamber aperture 17 receives surrounding water that contacts chamber wall primary side 32 and absorbs heat from a light emitting unit. Secondary chamber aperture 18 expels the heated water.

In FIG. 8, internal liquid cooling system 20 has housing 10 having a chamber opening 17 located on an end of port tube 40. Chamber wall secondary side 33 is where supporting surfaces 22A, 22B, 22C (FIG. 9), and 22D (FIG. 9) are located and do not come in contact with water. Supporting surface 22A is in thermal contact with circuit board 29A connected to light emitting unit 19A generating heat. Supporting surface 22B is in thermal contact with circuit board 29B connected to light emitting unit 19B.

As best understood in connection with FIG. 9, primary supporting surface 22A, secondary supporting surface 22B, tertiary supporting surface 22C, and quaternary supporting surface 22D form chamber 31 (FIG. 10) for water to come into contact with chamber wall primary side 32 and absorb heat generated from light emitting units 19A, 19B, 19 C, and 19 D. In FIG. 10, housing 10 is oriented with the peak of the chamber facing toward the surface of the water when submerged. Primary chamber aperture 17 receives surrounding water. Secondary chamber aperture 18 discharges the heated water. FIG. 10 illustrates internal cooling system 20 having housing 10 with power cord inlet 7 connected to a power cord (not shown) and valve stem opening 26 connected to a valve stem (not shown).

Figure 11:
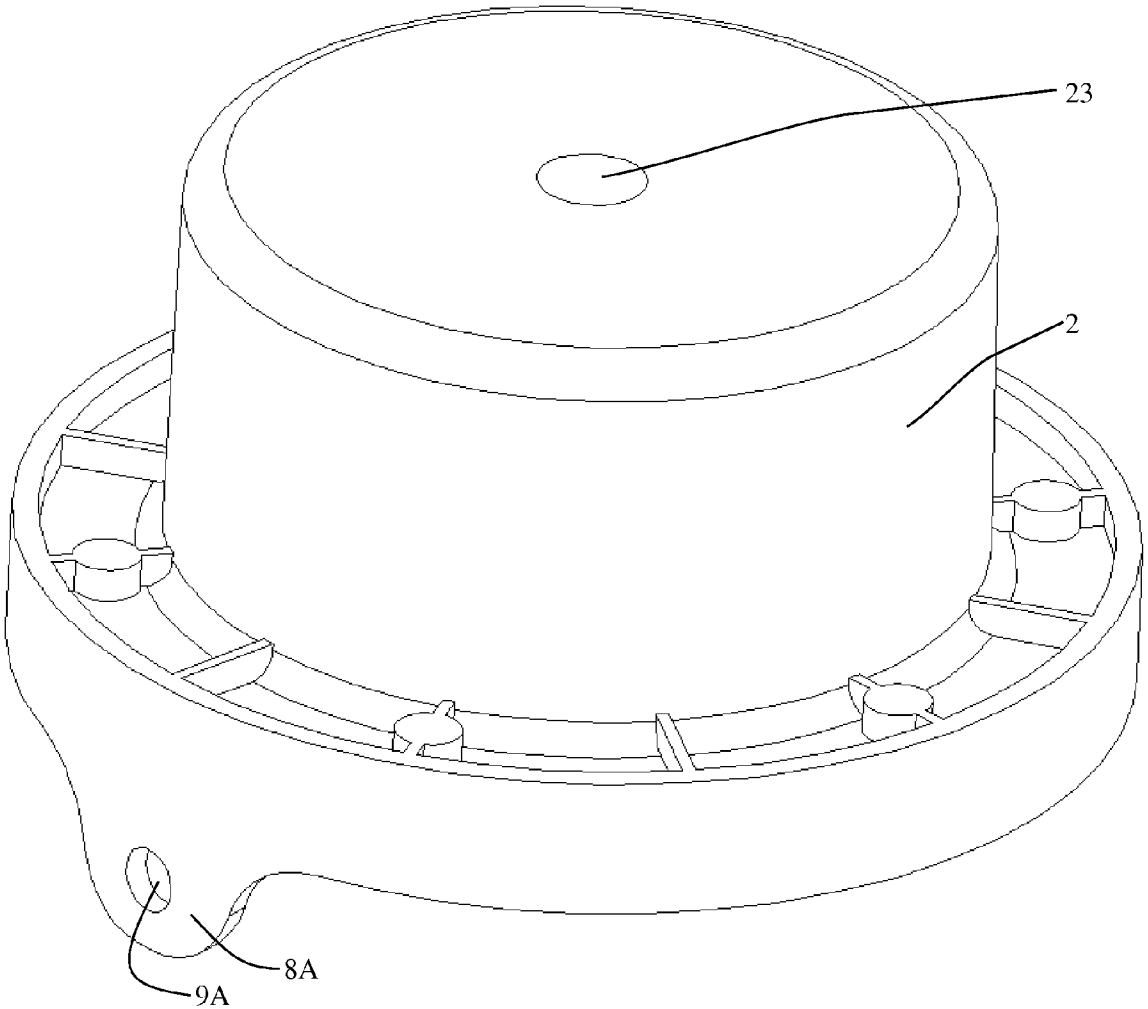
FIG. 11 is a perspective view of the transparent cover opening.
Figure 16:
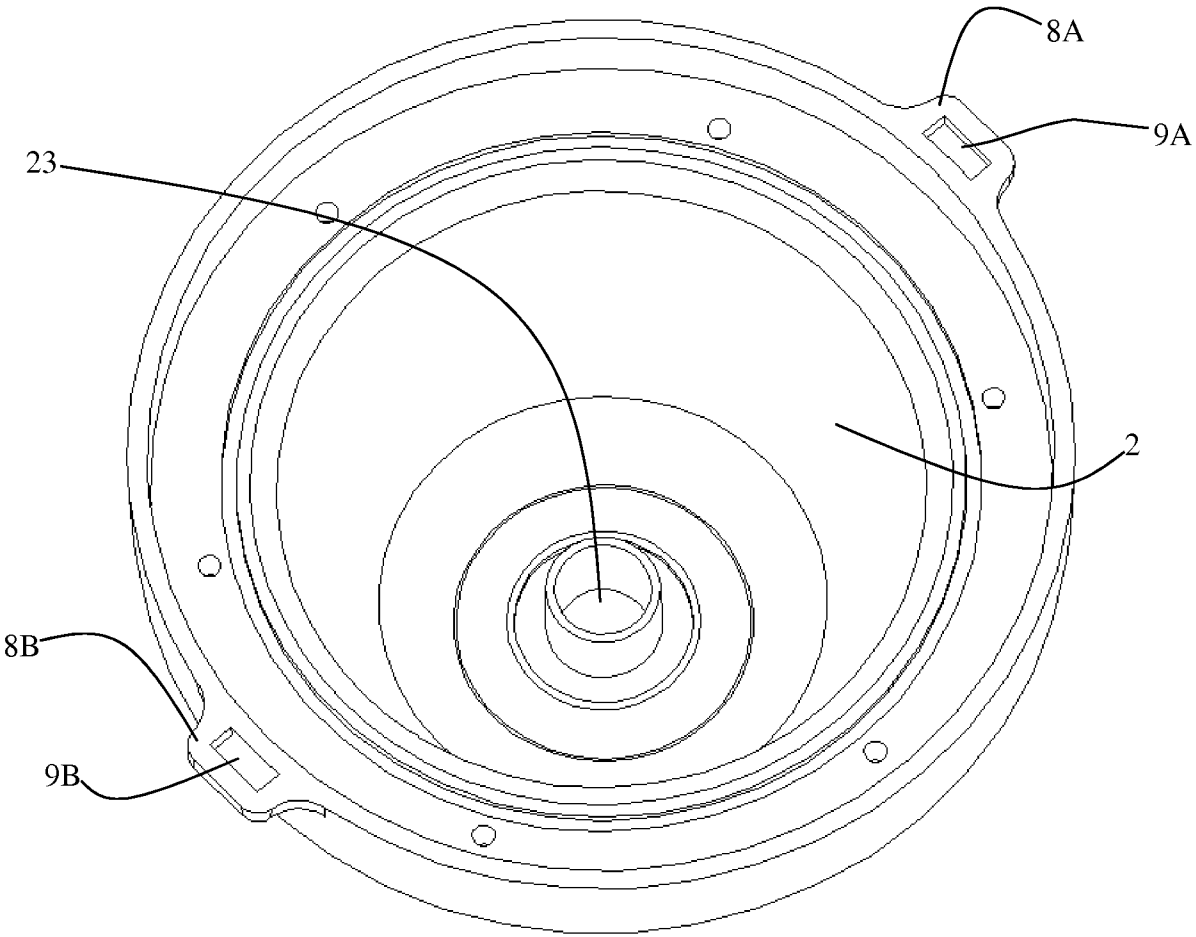
FIG. 16 is a rear perspective view of the inside of the transparent cover having an alternate embodiment of the attaching structures.
Figure 17:
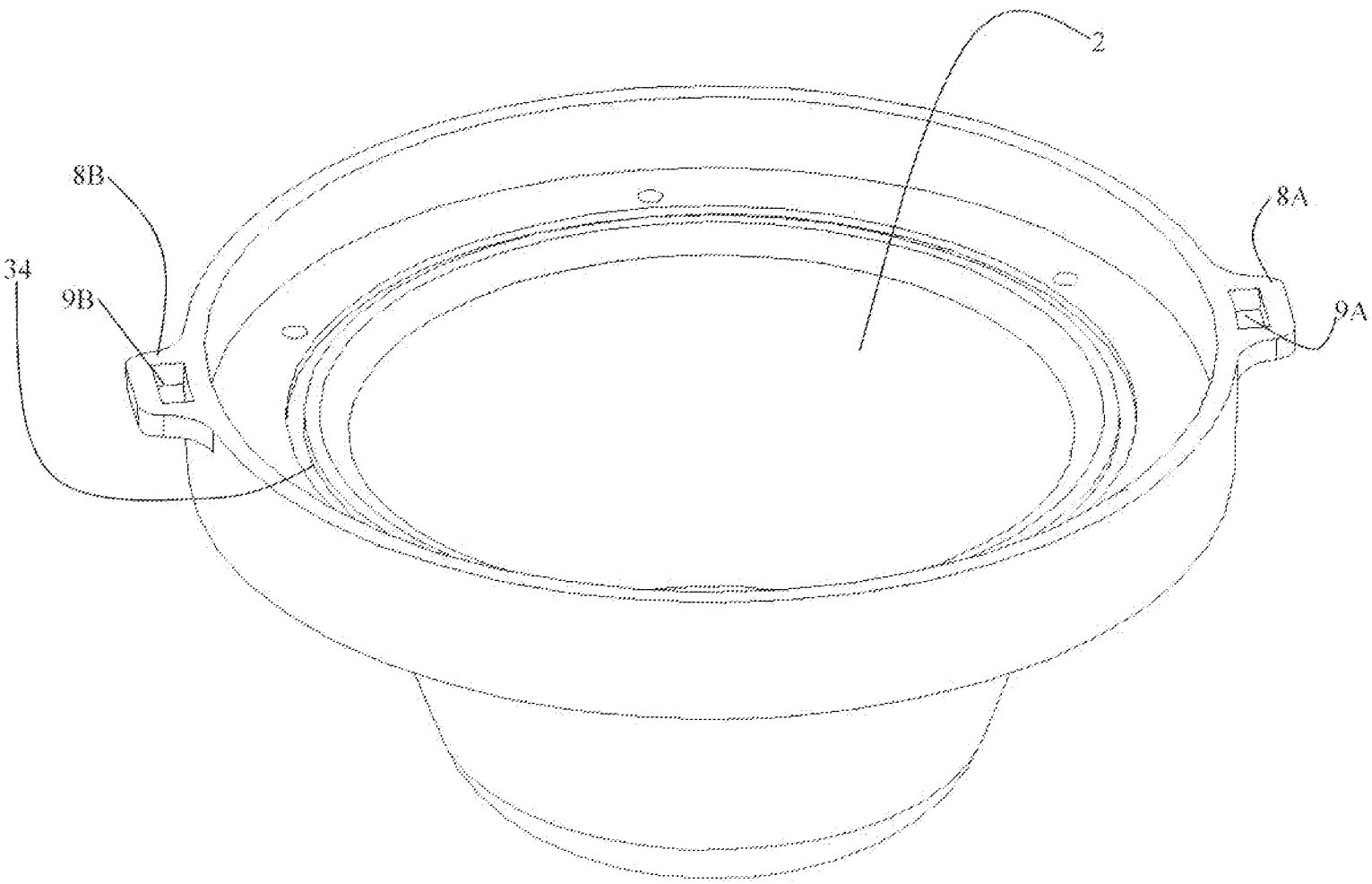
FIG. 17 is a perspective view of the transparent.
Figure 18:
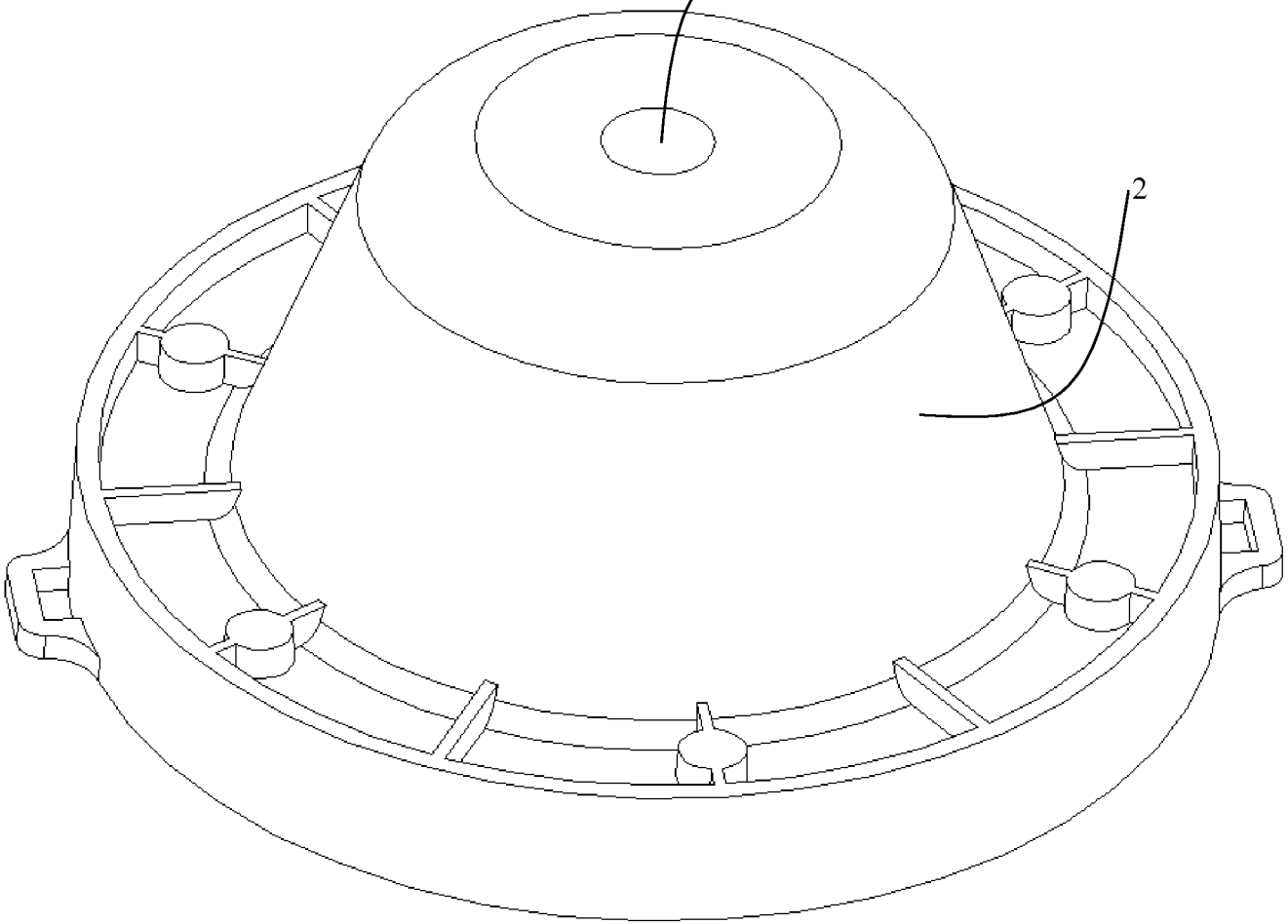
FIG. 18 is a perspective view of the top of the transparent cover.

Transparent Cover 2: As shown in FIG. 11, transparent cover opening 23 is located on an end of transparent cover 2. FIGS. 11 and 12 both depict attaching structure 8A having attaching structure opening 9A. FIG. 12 depicts attaching structure 8B having attaching structure opening 9B. FIGS. 16 and 17 depict a second embodiment of attaching structure 8A having opening 9A and attaching structure 8B as having attaching structure opening 9B. FIG. 17 illustrates transparent cover 2 having seal groove 34 that receives an O-ring (not shown). FIGS. 12, 16, and 18 illustrate transparent cover 2 having transparent cover opening 23.

Figure 13:
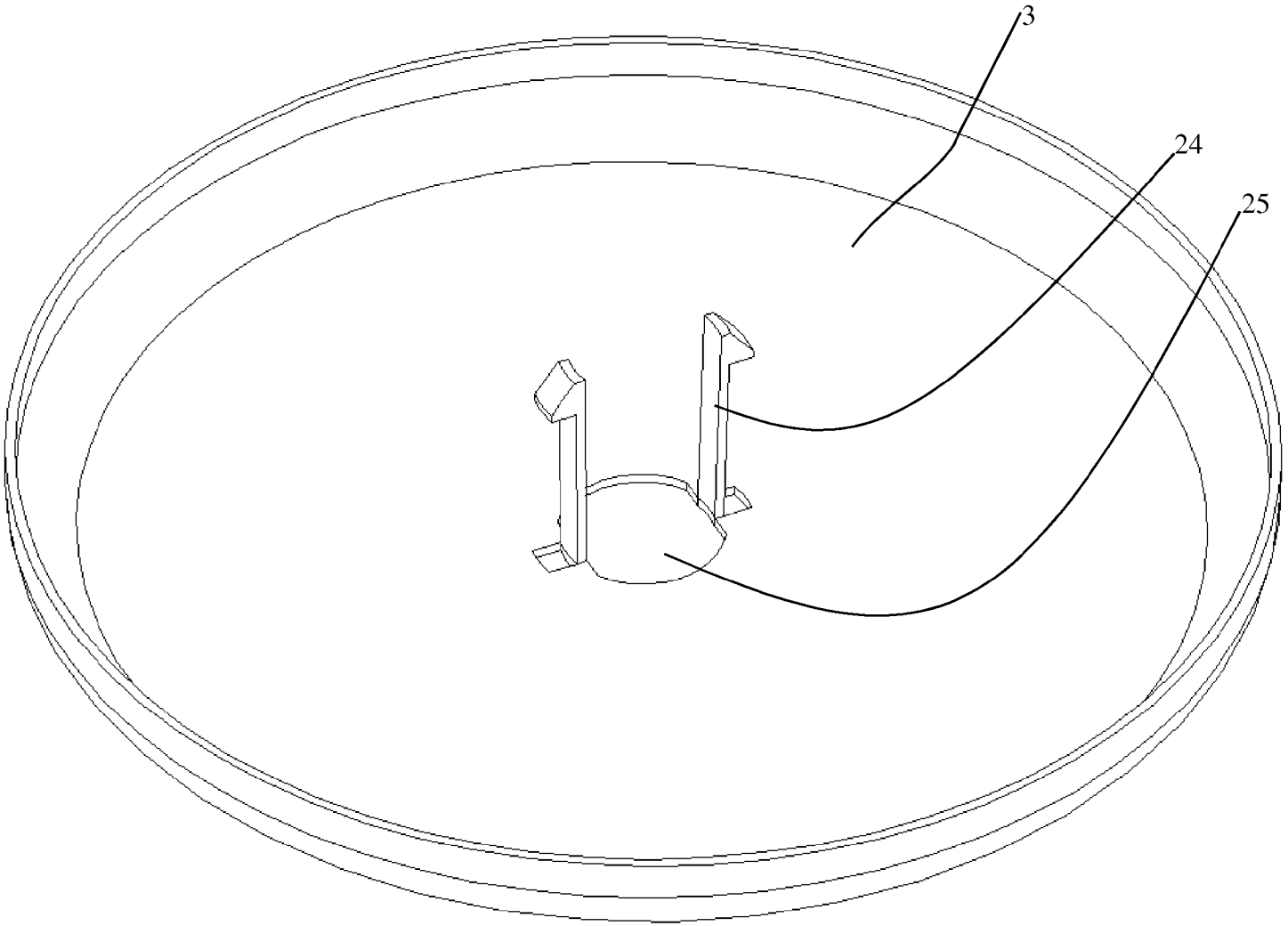
FIG. 13 is a rear perspective view of the latching structure of the transparent lens.
Figure 15:
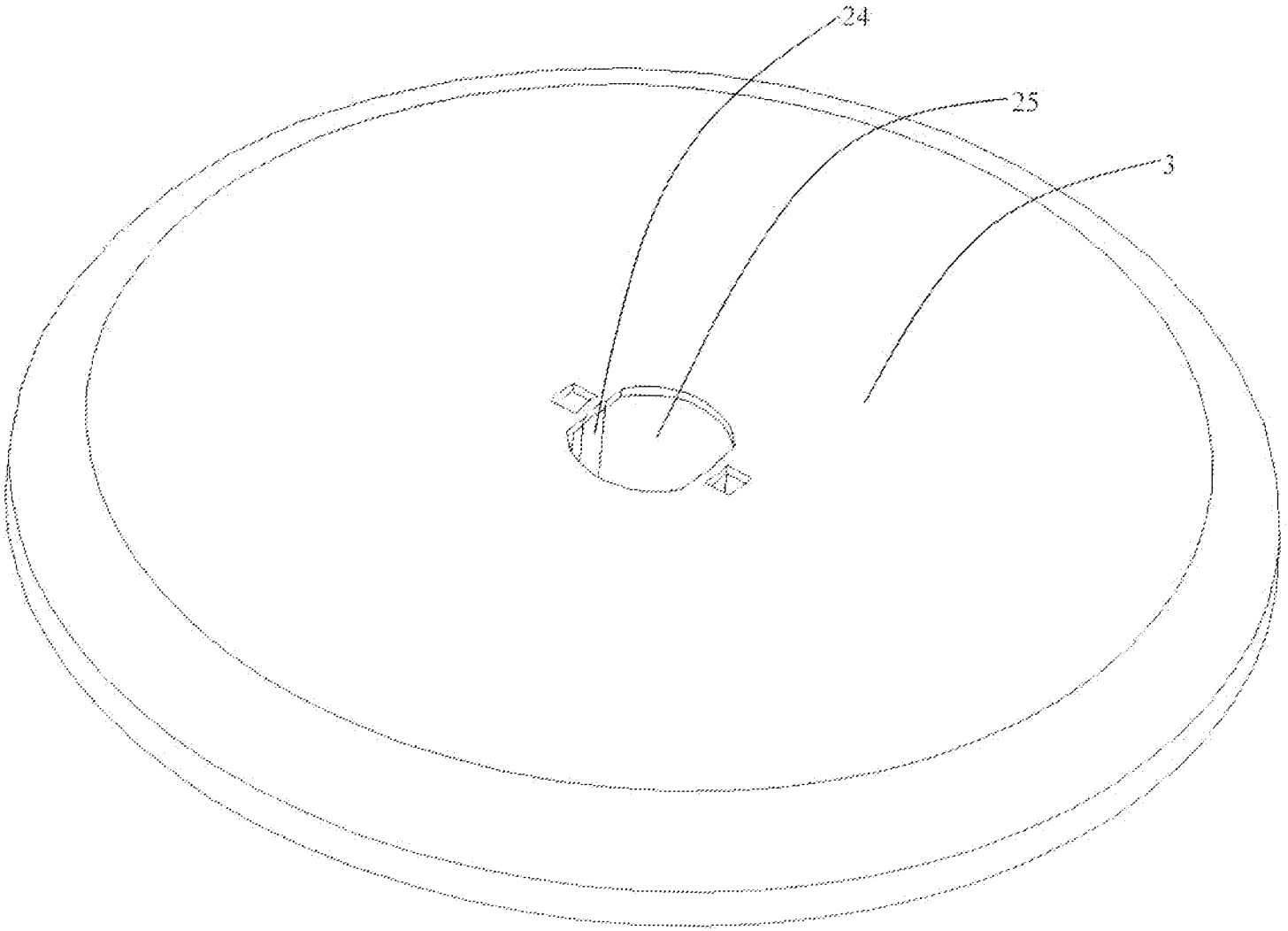
FIG. 15 is a perspective view of the top of the transparent lens.

As seen in FIGS. 13-15, transparent lens 3 has a transparent lens latching structure 24 and transparent lens opening 25. Transparent lens latching structure 24 is received by transparent cover opening 23 (FIG. 18).

Figure 19:
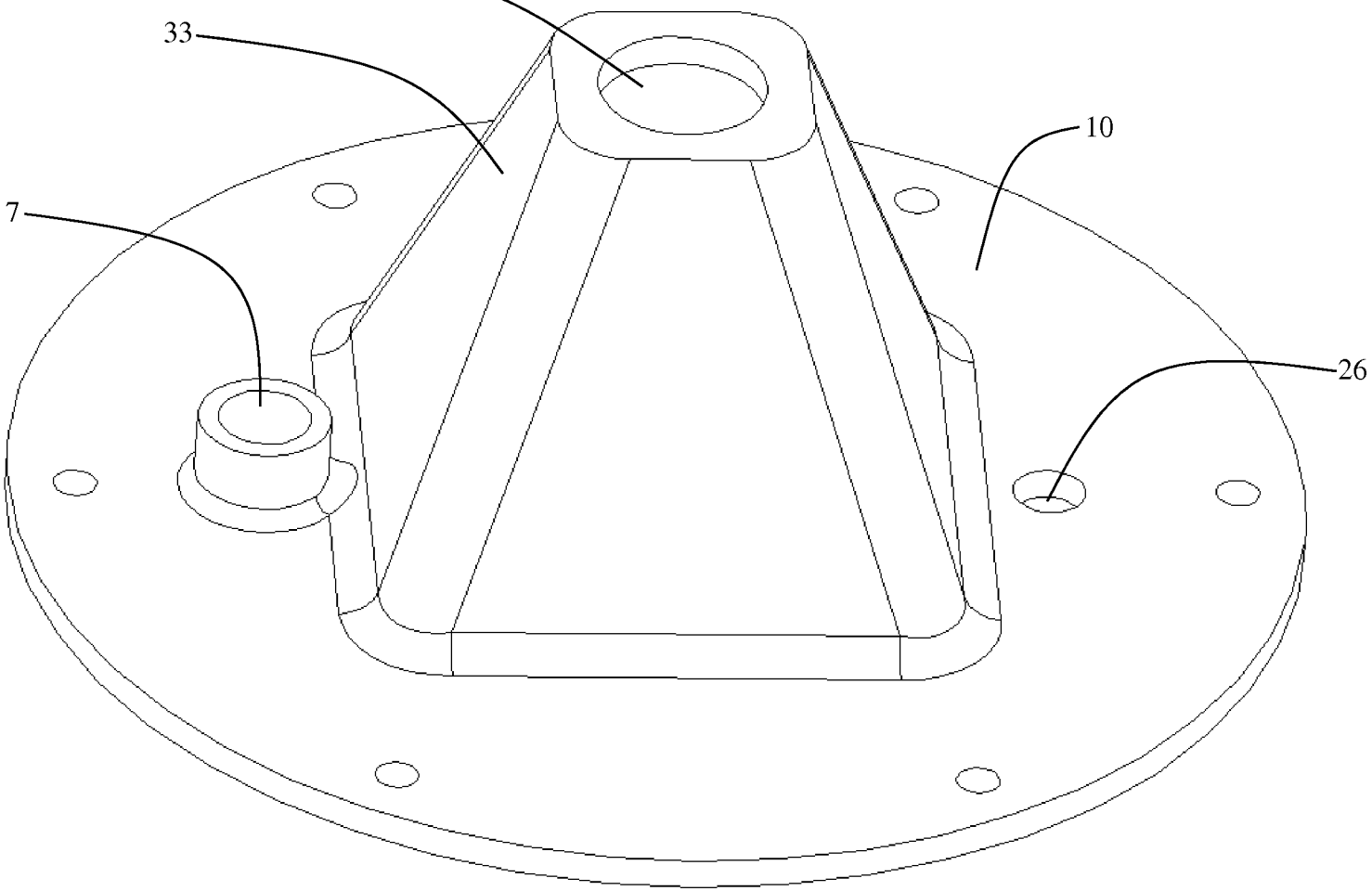
Figure 20:
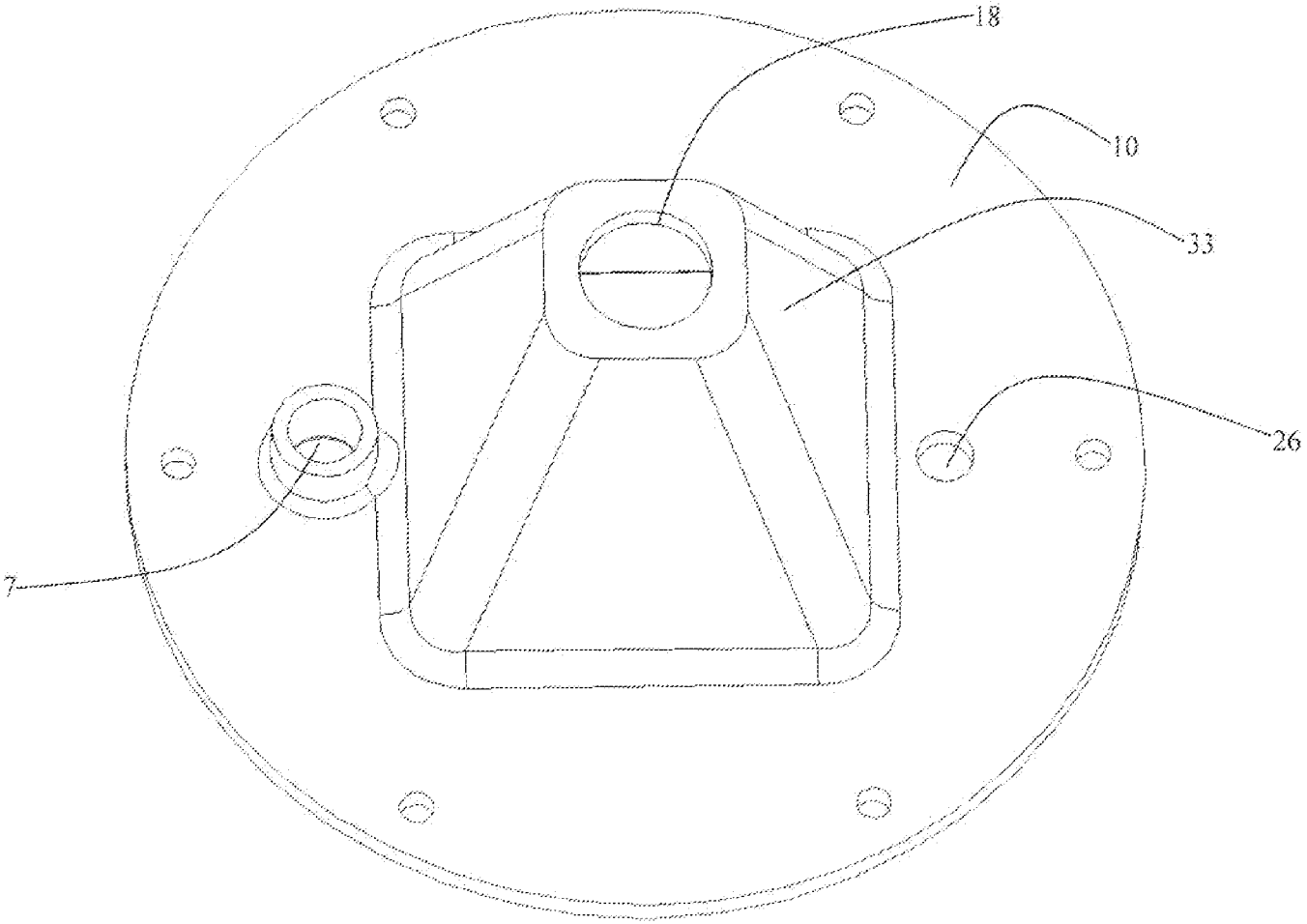
FIG. 20 is a top perspective view depicting an embodiment of the thermally conductive housing having an opening for a valve stem.

FIGS. 19-22 depict housing 10 having a valve stem opening 26. FIGS. 19 and 20 show chamber 31 (FIG. 21) having a chamber wall having a secondary side 33 that does not contact surrounding water. Power cord inlet 7 is located on housing 10. Heated water is expelled through secondary chamber aperture 18. FIG. 21 shows that surrounding water can enter chamber 31 through primary chamber aperture 17. The surrounding water comes into contact with the chamber wall primary side 32. FIG. 23 depicts light bifurcating structure 27 having light bifurcating structure primary surface 35 located opposite light bifurcating structure secondary surface 16. Light bifurcating structure 27 is located between light emitting units 19A and 19 E and 19B and 19 F. Power cord inlet 7 is located on housing 10 and receives a power cord (not shown). FIGS. 23 and 24 illustrate heated water (not shown) is expelled through secondary chamber aperture 18. Primary O-ring mating surface 36 comes into contact with secondary O-ring channel 39 (FIG. 26). Secondary O-ring mating surface 37 comes into contact with primary O-ring channel 38 (FIGS. 25 and 26). Chamber wall secondary side 33 does not contact surrounding water. Valve stem opening 26 is connected to a valve stem (not shown). As best shown in FIG. 26, housing 10 has secondary O-ring mating surface 37 which comes into contact with primary O-ring channel 38. Primary O-ring mating surface 36 comes into contact with secondary O-ring channel 39.

FIGS. 24-26 illustrate transparent cover 2 having transparent cover opening 23 (FIGS. 24 and 26) over housing 10. Chamber 31 (FIGS. 25 and 26) has secondary chamber opening 18 located opposite primary chamber opening 17 (FIGS. 25-26). Chamber 31 has a chamber wall secondary side 33 (FIGS. 23-26) that is not exposed to water and chamber wall primary side 32 that is exposed to water (FIGS. 25-26). Supporting surface 22A and 22B (FIGS. 23-25) are located on chamber wall secondary side 33 (FIG. 23-26). Valve stem opening 26 is located on housing 10. Power cord inlet 7 is located on housing 10.

TERMS

As used herein, the term "electrically conductive element", refers to any medium that transfers an electrical current. Examples include, but are not limited to: an electrical cord, circuit board, light bulb, or bulb socket.

As used herein, the term "hydro communication", refers to any path that water can move from one point to another.

As used herein, the term "light emitting unit", refers to anything that electrically generates illumination including, but not limited to; an incandescent bulb, a CFL bulb, or an LED bulb.

As used herein, the term "resin", refers to any material that can flow as a fluid and become hardened chemically or by cooling.

As used herein, the term "clear", refers to being a color.

As used herein, the term "anchor", includes, but is not limited to; any securing structure or weight.

As used herein, the term "vertical orientation", refers to configuration of the underwater light directing the transparent cover's distal end toward or away from a surrounding water's surface.

As used herein, the term "antifouling circuitry", refers to any circuitry capable of automatically cycling the power to the underwater light "on" and "off" multiple times for a predetermined duration during periods of non-use.

As used herein, the term "mounting surface", refers to any surface that supports components that emit light and generate heat including, but not limited to; circuit boards containing LED's.

As used herein, the term "thermal contact", refers to any transfer of heat from one surface to another including, but not limited to; an underlying surface, a light emitting unit, a structure, or a water source.

As used herein, the term "thermal communication", refers to any transfer of heat from one source to another including, but not limited to; a light emitting unit, a structure, or a water source.

As used herein, the term "sealing structure opening", refers to any opening in a sealing structure to receive an electrically conductive element.

As used herein, the term "surrounding water", refers to any water that comes into contact with the underwater light when submerged in a body of water.

As used herein, the term "attaching element", refers to any securing material, including but not limited to; a tether, rope, chain, or tie strap.

As used herein, the term "thermally conductive material", refers to any material that can absorb, release, or transfer heat.

As used herein, the term "valve", refers to any releasable mechanism allowing a user to fill or remove a gas from within the sealed area of the underwater light.

As used herein, the term "transparent cover", refers to any translucent barrier between a water source and a light emitting unit.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. An underwater light, comprising:

a transparent cover attached over a housing, said housing comprising a thermally conductive material; and, said housing comprising a chamber having a wall comprising a first side in contact with surrounding water, said chamber comprising a first supporting surface, a second supporting surface, and a third supporting surface, each of said supporting surfaces formed on a second side of said wall not in contact with said surrounding water, said chamber comprising an aperture on an end of said chamber receiving said surrounding water, each of said supporting surfaces supporting at least one light emitting unit generating heat, each of said supporting surfaces transferring heat from said at least one light emitting unit generating heat to said first side of said wall in contact with surrounding water, whereby said surrounding water is in thermal communication with said at least one light emitting unit generating heat.

2. The underwater light of claim 1, wherein said transparent cover is a first color comprising a transparent lens connected to an end of said transparent cover, said transparent lens being a second color, whereby said transparent cover illuminates an outer area of said surrounding water in said first color and said transparent lens illuminates a central area of said surrounding water in said second color.

3. The underwater light of claim 1, wherein said transparent cover has at least two attaching structures located on an end of said transparent cover, said at least two attaching structures each comprising at least one opening to receive an attaching element, said at least two attaching structures are located outboard of the perimeter of an aperture receiving said surrounding water, said attaching element is connected to an anchor configured to suspend said underwater light in a vertical orientation when submerged in a body of water.

4. The underwater light of claim 1, wherein said transparent cover comprises a single attaching structure bridging the perimeter of an aperture receiving said surrounding water, whereby said single attaching structure is configured to receive an attaching element connected to an anchor, said single attaching structure configured to suspend said underwater light in a vertical orientation when submerged in said body of water.

5. The underwater light of claim 1, wherein said chamber comprises a second aperture located on an end of said chamber opposing said first aperture, said chamber is configured to allow said surrounding water to flow through said chamber and a central aperture of said transparent cover, whereby said transparent cover central aperture is in hydro communication with said first aperture and said second aperture of said chamber.

6. The underwater light of claim 5, wherein said transparent cover central aperture is configured to allow said surrounding water to penetrate said transparent cover and an aperture in said transparent lens allowing said surrounding water to flow through said chamber.

7. The underwater light of claim 6 wherein, said transparent lens has a latching structure configured to connect said transparent lens to an end of said transparent cover, whereby said central aperture of said transparent cover receives said latching structure.

8. The underwater light of claim 1, wherein said chamber has a larger perimeter on an end tapering to a smaller perimeter on an opposite end, said chamber having a second aperture located on an end of said chamber.

9. The underwater light of claim 1, wherein said housing has at least two attaching structures located on an end of said housing, said at least two attaching structures are located outboard of the perimeter of an aperture receiving said surrounding water, said at least two attaching structures each have at least one attaching structure opening to receive an attaching element, whereby said at least two attaching structures are configured to suspend said underwater light in a vertical orientation when submerged in a body of water.

10. The underwater light of claim 1, wherein said housing has a single attaching structure bridging the perimeter of an aperture receiving said surrounding water, whereby said single attaching structure is configured to receive an attaching element connected to an anchor, said single attaching structure configured to suspend said underwater light in a vertical orientation when submerged in said body of water.

11. The underwater light of claim 1, wherein said underwater light has an opening to accommodate a port having a valve capable of removing or filling a gas from a void between said housing and said transparent cover.

12. The underwater light of claim 1, wherein at least three said supporting surfaces each support at least two said light emitting units, whereby each of said at least three supporting surfaces support a first light emitting unit of a first color and a second light emitting unit of a second color, said first light emitting unit of a first color and said second light emitting unit of a second color are oriented in an upper and lower position related to the central axis of said underwater light, said underwater light comprising a light bifurcating structure, said light bifurcating structure having a first surface opposite a second surface, said light bifurcating structure positioned between said first light emitting unit of a first color and said second light emitting unit of a second color, said light bifurcating structure extending from a point substantially related to or connected to a surface supporting said first light emitting unit of a first color and said second light emitting unit of a second color, said light bifurcating structure extending opposite the point of contact of said first light emitting unit of a first color and said second light emitting unit of a second color to a point where said light bifurcating structure obstructs a portion of light from said first light emitting unit of a first color and a portion of light from said second light emitting unit of a second color, whereby, said light bifurcating structure causes an outer area of water to illuminate in a first color and a central portion of water to illuminate in a second color.

13. The underwater light of claim 1, wherein said underwater light comprises antifouling circuitry, said antifouling circuitry configured to automatically cycle on and off said underwater light multiple times during periods of non-use.

14. The underwater light of claim 1, wherein said underwater light comprises processing circuitry comprising a program, said processing circuitry configured to control a power interrupt circuit that powers said at least one light emitting unit, said processing circuitry capable of accepting commands through said underwater light's power cord, whereby, said processing circuitry can command said power interrupt circuit to open or close a power supply to said at least one light emitting unit.

15. The underwater light of claim 14, wherein said processing circuitry is configured to cycle on and off said power interrupt circuit a predetermined number of times causing said at least one light emitting unit to flash on and off said predetermined amount of times, said flashing indicating a fault or mode of operation to a user.

16. The underwater light of claim 15, wherein said processing circuitry is configured to monitor temperature of said underwater light, said processing circuitry configured to command said power interrupt circuit to open said power source to said at least one light emitting unit upon reaching a predetermined maximum temperature causing said underwater light to shut off.

17. An underwater light, comprising:

a transparent cover, said transparent cover attached over a housing;

said housing comprising a chamber having a wall in contact with surrounding water, said chamber comprising of a thermally conductive material;

said housing having at least one supporting surface on an opposite side of said wall at an angle between 0 degrees and 85 degrees in relation to the central axis of said underwater light;

said at least one supporting surface in thermal contact with a light emitting unit generating heat;

said chamber having a first chamber aperture receiving surrounding water;

said transparent cover having a central aperture in hydro communication with a second chamber aperture allowing water to flow through said first chamber aperture and said second chamber aperture and said transparent cover central aperture; and, said housing has a second supporting surface at an angle between 0 degrees and 85 degrees in relation to the central axis of said underwater light, said housing having a third supporting surface at an angle between 0 degrees and 85 degrees in relation to the central axis of said underwater light, said first supporting surface, said second supporting surface, and said third supporting surfaces are each in thermal contact with at least one said light emitting unit generating heat, said first supporting surface, said second supporting surface, and said third supporting surface walls are configured to form said chamber, said chamber having said first chamber aperture being a first perimeter located on an end of said chamber, said first chamber aperture receiving surrounding water of a first temperature, said chamber having said second chamber aperture being a second perimeter located opposite said first chamber aperture, said first chamber aperture being at least ten percent larger or smaller in perimeter than said second chamber aperture, at least one chamber aperture expelling said surrounding water from inside said chamber at a second temperature greater than said surrounding water of a first temperature.

18. The underwater light of claim 17, wherein at least three said supporting surfaces each support at least two said light emitting units, whereby each of said at least three supporting surfaces support a first light emitting unit of a first color and a second light emitting unit of a second color, said first light emitting unit of a first color and said second light emitting unit of a second color are oriented in an upper and lower position related to the central axis of said underwater light, said underwater light comprising a light bifurcating structure, said light bifurcating structure having a first surface opposite a second surface, said light bifurcating structure positioned between said first light emitting unit of a first color and said second light emitting unit of a second color, said light bifurcating structure extending from a point substantially related to or connected to a surface supporting said first light emitting unit of a first color and said second light emitting unit of a second color, said light bifurcating structure extending opposite the point of contact of said first light emitting unit of a first color and said second light emitting unit of a second color to a point where said light bifurcating structure obstructs a portion of light from said first light emitting unit of a first color and a portion of light from said second light emitting unit of a second color, whereby, said light bifurcating structure causes an outer area of water to illuminate in a first color and a central portion of water to illuminate in a second color.

19. An underwater light, comprising:

a housing comprising a chamber comprising a plurality of supporting surfaces;

said chamber comprising a thermally conductive material;

said chamber comprising a large perimeter on an end tapering to a smaller perimeter on an opposite end;

said chamber comprising a first chamber aperture located on an end of said chamber, whereby said first chamber aperture receives surrounding water of a first temperature;

said first chamber aperture configured to allow surrounding water to substantially fill said chamber, at least one light emitting unit generating heat supported by at least one said supporting surface, said at least one supporting surface in thermal communication with its opposite surface contacting said surrounding water; and, a transparent cover attached over said housing, said transparent cover having a central aperture in hydro communication with a second chamber aperture, whereby at least one chamber aperture expels said surrounding water of a first temperature from inside said chamber at a second temperature greater than said surrounding water of a first temperature.

20. The underwater light of claim 19, wherein said housing is connected to a light fixture housing having at least two formed attaching structures located on an end of said light fixture housing, whereby said at least two formed attaching structures are configured to equally suspend said underwater light in a body of water, said underwater light displacing a volume of water causing said underwater light to be buoyant, said at least two formed attaching structures each have at least one attaching structure opening to receive an attaching element.

21. The underwater light of claim 20, wherein said at least two formed attaching structures each receive an attaching element connected to an anchor configured to suspend said underwater light in a vertical orientation when submerged in a body of water.

22. The underwater light of claim 20, wherein said light fixture housing has an opening to accommodate a valve capable of removing or filling said underwater light with a gas.

23. The underwater light of claim 19, wherein said underwater light comprises antifouling circuitry, said antifouling circuitry configured to automatically cycle on and off said underwater light multiple times during periods of non-use.

24. The underwater light of claim 19, wherein at least three said supporting surfaces each support at least two said light emitting units, whereby each of said at least three supporting surfaces support a first light emitting unit of a first color and a second light emitting unit of a second color, said first light emitting unit of a first color and said second light emitting unit of a second color are oriented in an upper and lower position related to the central axis of said underwater light, said underwater light comprising a light bifurcating structure, said light bifurcating structure having a first surface opposite a second surface, said light bifurcating structure positioned between said first light emitting unit of a first color and said second light emitting unit of a second color, said light bifurcating structure extending from a point substantially related to or connected to a surface supporting said first light emitting unit of a first color and said second light emitting unit of a second color, said light bifurcating structure extending opposite the point of contact of said first light emitting unit of a first color and said second light emitting unit of a second color to a point where said light bifurcating structure obstructs a portion of light from said first light emitting unit of a first color and a portion of light from said second light emitting unit of a second color, whereby, said light bifurcating structure causes an outer area of water to illuminate in a first color and a central portion of water to illuminate in a second color.

25. An underwater light, comprising:

a light fixture housing comprising a chamber;

said chamber comprising at least one wall;

said at least one wall comprising a first side in contact with surrounding water;

said chamber comprising a supporting surface formed on a second side of said at least one wall;

said second side of said at least one wall being opposite said first side of said at least one wall;

at least one light emitting unit supported by said supporting surface; and, said first side of said at least one wall being in thermal communication with said at least one light emitting unit, whereby heat is transferred from said at least one light emitting unit to the surrounding water; and, at least three supporting surfaces each support at least two said light emitting units, whereby each of said at least three supporting surfaces support a first light emitting unit of a first color and a second light emitting unit of a second color, wherein said first light emitting unit of a first color and said second light emitting unit of a second color are oriented in an upper and lower position related to the central axis of said underwater light, said underwater light comprising a light bifurcating structure, said light bifurcating structure having a first surface opposite a second surface, said light bifurcating structure positioned between said first light emitting unit of a first color and said second light emitting unit of a second color, said light bifurcating structure extending from a point substantially related to or connected to a surface supporting said first light emitting unit of a first color and said second light emitting unit of a second color, said light bifurcating structure extending opposite the point of contact of said first light emitting unit of a first color and said second light emitting unit of a second color to a point where said light bifurcating structure obstructs a portion of light from said first light emitting unit of a first color and a portion of light from said second light emitting unit of a second color, whereby, said light bifurcating structure causes an outer area of water to illuminate in a first color and a central portion of water to illuminate in a second color.

* * * * *